US009437167B2

(12) United States Patent
Shin et al.

(10) Patent No.: US 9,437,167 B2
(45) Date of Patent: Sep. 6, 2016

(54) ORGANIC LIGHT-EMITTING DISPLAY DEVICE HAVING A HIGH APERTURE RAATIO AND DRIVING METHOD THEREOF

(71) Applicant: LG DISPLAY CO., LTD., Seoul (KR)

(72) Inventors: HunKi Shin, Paju-si (KR); BumSik Kim, Suwon-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 14/522,145

(22) Filed: Oct. 23, 2014

(65) Prior Publication Data

US 2015/0130785 A1 May 14, 2015

(30) Foreign Application Priority Data

Nov. 14, 2013 (KR) ..... 10-2013-0138238

(51) Int. Cl.
*G09G 5/18* (2006.01)
*G09G 3/32* (2016.01)

(52) U.S. Cl.
CPC ..... *G09G 5/18* (2013.01); *G09G 3/3233* (2013.01); *G09G 3/3291* (2013.01); *G09G 2300/0465* (2013.01); *G09G 2300/0842* (2013.01); *G09G 2310/0262* (2013.01); *G09G 2320/0295* (2013.01); *G09G 2320/043* (2013.01)

(58) Field of Classification Search
CPC .... G09G 5/18; G09G 3/3233; G09G 3/3291; G09G 2300/0842; G09G 2310/0262; G09G 2320/0295; G09G 2320/043
USPC ..... 313/504–507
See application file for complete search history.

(56) References Cited

U.S. PATENT DOCUMENTS

| | | | |
|---|---|---|---|
| 2008/0158110 | A1 | 7/2008 | Iida et al. |
| 2012/0086694 | A1 | 4/2012 | Tseng et al. |
| 2012/0299978 | A1 | 11/2012 | Chaji |
| 2013/0050292 | A1 | 2/2013 | Mizukoshi |
| 2013/0169699 | A1 | 7/2013 | Jeong et al. |
| 2013/0201173 | A1 | 8/2013 | Chaji et al. |

FOREIGN PATENT DOCUMENTS

| | | | |
|---|---|---|---|
| CN | 101211535 | A | 7/2008 |
| CN | 101373578 | A | 2/2009 |
| CN | 103077662 | A | 5/2013 |
| KR | 10-2008-0061268 | A | 7/2008 |
| KR | 10-0873707 | B1 | 12/2008 |
| KR | 10-2013-0024744 | A | 3/2013 |
| WO | 2007090287 | A1 | 8/2007 |
| WO | 2013100686 | A1 | 7/2013 |

*Primary Examiner* — Tracie Y Green
(74) *Attorney, Agent, or Firm* — Dentons US LLP

(57) ABSTRACT

Disclosed is an organic light-emitting display device and operating method thereof that may include an organic light-emitting diode, a first transistor controlled by a sensing signal and connected to a data line, a second transistor controlled by a scanning signal and connected to the data line, and a driving transistor having first to third nodes, wherein a reference voltage is applied to the first node through the first transistor, a data voltage is applied to the second node through the second transistor, and the third node is connected to a driving voltage line.

8 Claims, 27 Drawing Sheets

ORGANIC LIGHT-EMITTING DISPLAY DEVICE HAVING A HIGH APERTURE RAATIO AND DRIVING METHOD THEREOF

CROSS REFERENCE TO RELATED APPLICATION

This application claims the benefit of Korean Patent Application No. 10-2013-0138238 filed on Nov. 14, 2013, which is hereby incorporated by reference for all purposes as if fully set forth herein.

BACKGROUND OF THE INVENTION

1. Field of the Invention

The present invention relates to an organic light-emitting display device and operating method thereof.

2. Description of Related Art

Recently, organic light-emitting display devices have been in the spotlight as the next generation display devices. Organic light-emitting display devices use organic light-emitting diodes (OLEDs) that emit light by themselves, and have advantages such as relatively fast response speed, high levels of light emitting efficiency and luminance, as well as wide viewing angles.

Such an organic light-emitting display device has a structure in which pixels including organic light-emitting diodes are arranged in a matrix form, and the brightness of pixels may be controlled through the selection of a scanning signal according to the grayscale data.

Each pixel in such an organic light-emitting display device has a structure in which an organic light-emitting diode, a driving transistor for driving the organic light-emitting diode, a storage capacitor and the like are connected to various signal lines.

Since a conventional pixel structure requires a reference voltage line for initializing a source node (or a drain node) of the driving transistor, the reference voltage line is formed in a display panel for each pixel and is directly connected to respective data driving integrated circuits.

As a result, a problem may occur in which an aperture ratio of the display panel is reduced, as the number of contacts of the data integrated circuits is increased.

SUMMARY OF THE INVENTION

Accordingly, the present invention is directed to an organic light-emitting display device and operating method thereof that substantially obviates one or more of the problems due to limitations and disadvantages of the related art.

An advantage of the present invention is to provide an organic light-emitting display device having a novel pixel structure with a high aperture ratio and an operating method thereof.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, an organic light-emitting display device may, for example, include a display panel including a plurality of data lines, a plurality of first gate lines and a plurality of second gate lines, which define a plurality of pixels; a data driver supplying a data signal through at least one of the plurality of data lines; a first gate driver supplying a sensing signal through at least one of the plurality of first gate lines that cross the plurality of data lines in the display panel; a second gate driver supplying a scanning signal through at least one of the plurality of second gate lines that are substantially parallel with the plurality of first gate lines in the display panel; and a timing controller controlling driving timings of the data driver, the first gate driver and the second gate driver, wherein one of the plurality of pixels includes an organic light-emitting diode, a driving transistor having a first node, a second node and a third node, a first transistor controlled by the sensing signal and connected between the respective data line and the first node of the driving transistor, a second transistor controlled by the scanning signal and connected between the respective data line and the second node of the driving transistor, and a storage capacitor connected between the first and second nodes of the driving transistor.

In another aspect of the present invention, an organic light-emitting display device may, for example, include an organic light-emitting diode (OLED); a first transistor controlled by a sensing signal and connected to a data line; a second transistor controlled by a scanning signal and connected to the data line; and a driving transistor having a first node to which a reference voltage is applied through the first transistor, a second node to which a data voltage is applied through the second transistor, and a third node connected to a driving voltage line.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Reference will now be made in detail to embodiments of the present invention, examples of which are illustrated in the accompanying drawings. The same reference numbers may be used throughout the drawings to refer to the same or like parts. Detailed descriptions of known functions and components incorporated herein may be omitted.

Although terms such as "first," "second," "A," "B," "(a)" and "(b)" may be used herein to describe various elements, such terms may be used to distinguish one element from another element. The substance, sequence, order or number of these elements may not be limited by these terms. When an element is referred to as being "connected to" or "coupled to" another element, not only can it be "directly connected" or "coupled to" the other element, but it also can be "indirectly connected or coupled to" the other element via an "intervening" element(s). Also, when an element is referred to as being formed "on" or "under" another element, not only can it be directly formed on or under another element, but it also can be indirectly formed on or under another element via an intervening element(s).

Figure 1:
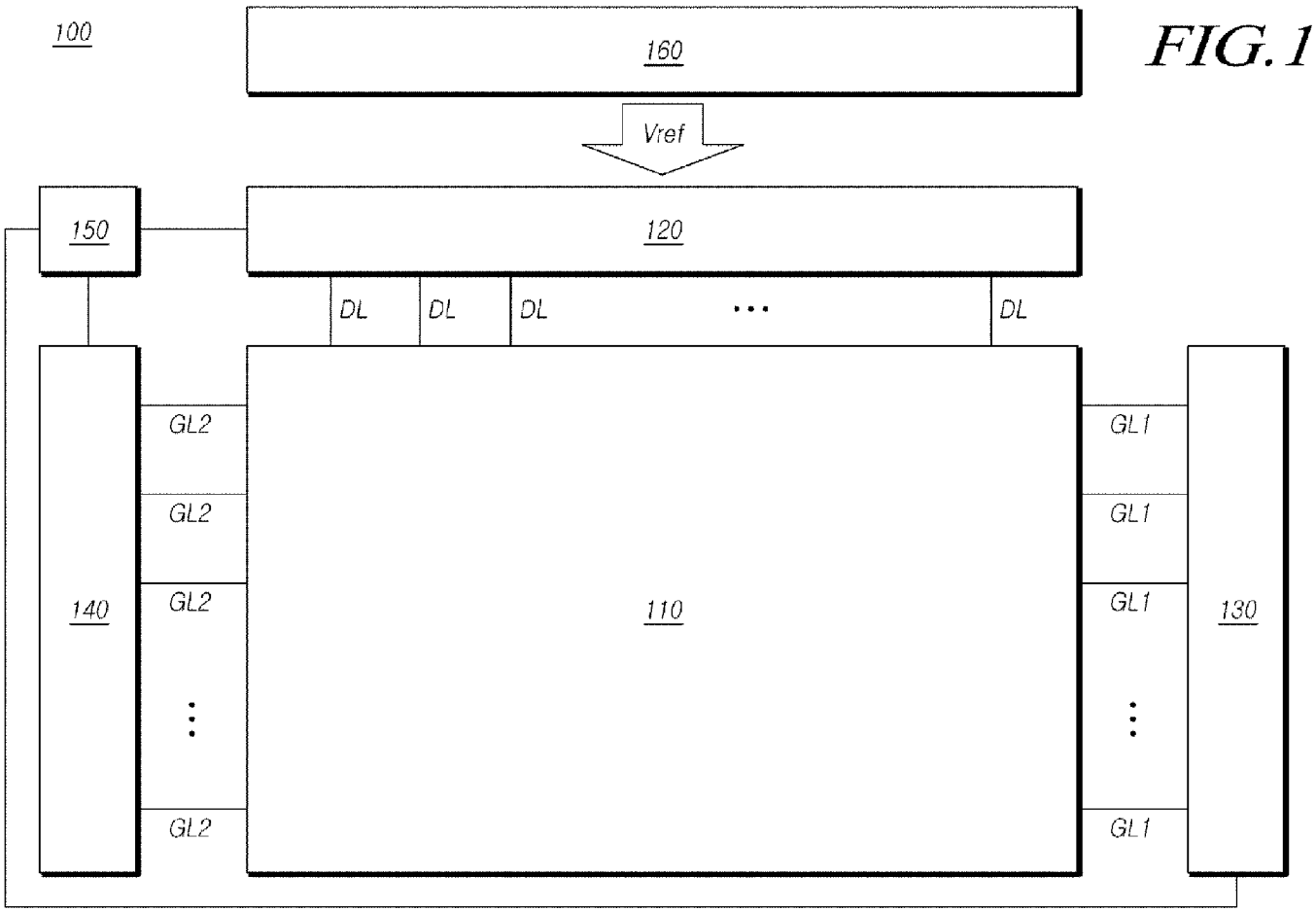
FIG. 1 is a diagram illustrating the system of an organic light-emitting display device according to an exemplary embodiment.

FIG. 1 is a diagram illustrating a system of an organic light-emitting display device 100 according to an exemplary embodiment.

Referring to FIG. 1, the organic light-emitting display device 100 includes a display panel 110 in which a plurality of data lines DL, a plurality of first gate lines GL1, and a plurality of second gate lines GL2 are formed and a plurality of pixels P are defined, a data driver 120 that drives the plurality of data lines DL formed in one direction on the display panel 110, a first gate driver 130 that supplies a sensing signal through the first gate lines GL1 crossing the data lines DL on the display panel 110, a second gate driver 140 that supplies a scanning signal through the second gate lines GL2 formed in parallel with the first gate lines GL1 on the display panel 110, a timing controller 150 that controls the driving timings of the data driver 120, the first gate driver 130 and the second gate driver 140, and a reference voltage supply unit 160 that supplies a reference voltage Vref to each pixel as a common voltage.

The first gate driver 130 and the second gate driver 140 may be separately provided, and may also be included in one gate driver as desired.

The first gate driver 130 may be positioned only at one side of the display panel 110 as illustrated in FIG. 1 or may be divided into two and positioned at both sides of the display panel 110 depending on a driving scheme. Similarly, the second gate driver 140 may also be variously positioned.

Each of the first gate driver 130 and the second gate driver 140 may include a plurality of gate driving integrated circuits. Such gate driving integrated circuits may be connected to bonding pads of the display panel 110 by using a tape automated bonding (TAB) method or a chip on glass (COG) method, or may be provided in a gate in panel (GIP) type directly formed on the display panel 110. Furthermore, the first gate driver 130 and the second gate driver 140 may be integrated with the display panel 110.

The data driver 120 may include a plurality of data driving integrated circuits (also referred to as source driving integrated circuits). Such data driving integrated circuits may be connected to bonding pads of the display panel 110 by using the tape automated bonding (TAB) method or the chip on glass (COG) method, or may be directly formed on the display panel 110. Furthermore, the data driver 120 may be integrated with the display panel 110.

The reference voltage supply unit 160 may be connected to the data driving integrated circuit D-IC of the data driver 120, and may supply the reference voltage Vref to a reference voltage line RVL formed on the display panel 110 through the data driving integrated circuit D-IC.

A pixel structure of each pixel P defined in the display panel 110 of the organic light-emitting display device 100 according to an exemplary embodiment will be described with reference to FIG. 2.

Figure 2:
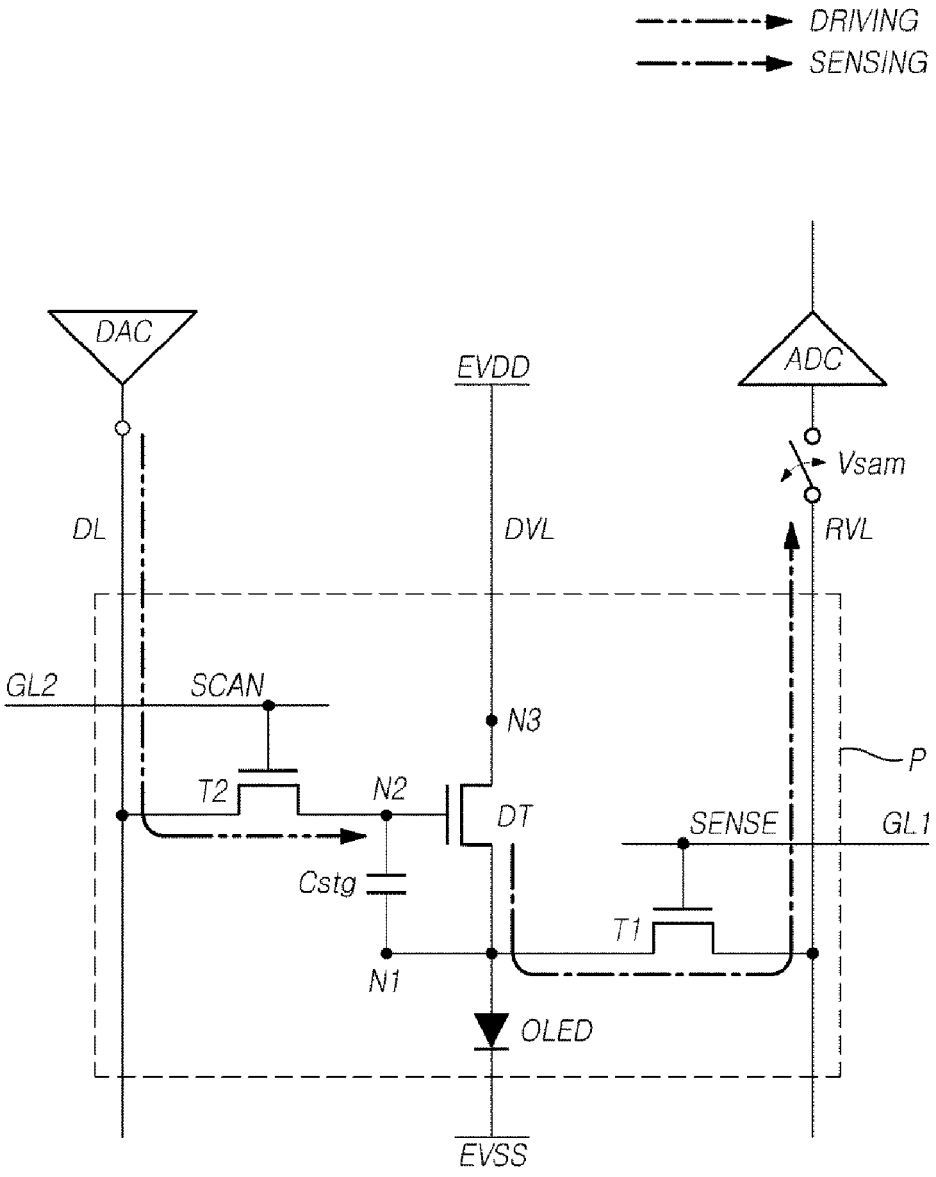
FIG. 2 is an equivalent circuit diagram illustrating a pixel structure of an organic light-emitting display device according to an exemplary embodiment.

FIG. 2 is an equivalent circuit diagram illustrating a pixel structure of an organic light-emitting display device 100 according to an exemplary embodiment.

Referring to FIG. 2, each pixel P in the display panel 110 of the organic light-emitting display device 100 includes an organic light-emitting diode (OLED), a driving transistor DT, a first transistor T1, a second transistor T2, a storage capacitor Cstg. The driving transistor DT has a first node N1, a second node N2 and a third node N3. The first transistor T1 is controlled by a sensing signal SENSE supplied through the first gate line GL1 and is connected between the reference voltage line RVL (Vref Line) and the first node N1 of the driving transistor DT. The second transistor T2 is controlled by a scanning signal SCAN supplied through the second gate line GL2 and is connected between the data line DL and the second node N2 of the driving transistor DT. The storage capacitor Cstg is connected between the first node N1 and the second node N2 of the driving transistor DT.

The driving transistor DT in each pixel P is a transistor that receives a driving voltage EVDD supplied by a driving voltage line DVL, is controlled by a voltage (a data voltage) of the second node N2, which is applied through the second transistor T2, and drives the organic light-emitting diode (OLED).

The driving transistor DT has the first node N1, the second node N2 and the third node N3, wherein the first node N1 is connected to the first transistor T1, the second node N2 is connected to the second transistor T2, and the third node N3 receives the driving voltage EVDD.

The first node of the driving transistor DT may be referred to as a source node (also referred to as a "source electrode"), the second node may be referred to as a gate node (also referred to as a "gate electrode"), and the third node N3 may be referred to as a drain node (also referred to as a "drain electrode"). The first node and the third node of the driving transistor DT may also be a drain node and a source node depending on a circuit implementation scheme or a circuit state.

The first transistor T1 is a transistor that is controlled by the sensing signal SENSE supplied by the first gate line GL1, is connected between the reference voltage line RVL supplying the reference voltage Vref or a connection pattern CP connected to the reference voltage line and the first node N1 of the driving transistor DT, and is concerned in a sensing mode, and is also referred to as a "sensor transistor."

The second transistor T2 is a transistor that is controlled by the scanning signal SCAN supplied by the second gate line GL2, is connected between a corresponding data line DL and the second node N2 of the driving transistor DT, and switches a data voltage to be applied to the second node N2 of the driving transistor DT, and is also referred to as a "switching transistor."

The storage capacitor Cstg is connected between the first node N1 and the second node N2 of the driving transistor DT, and maintains the data voltage during, for example, one frame period.

As illustrated in FIG. 2, each pixel defined in the display panel 110 of the organic light-emitting display device 100 according to an exemplary embodiment has a 3T (Transistor) 1C (Capacitor) structure including the three transistors DT, T1 and T2 and the one capacitor Cstg.

Furthermore, as illustrated in FIG. 2, each pixel defined in the display panel 110 of the organic light-emitting display device 100 according to an exemplary embodiment requires three vertical signal lines including the data line DL, the driving voltage line (DVL: EVDD Line) and the reference voltage line RVL, and two horizontal signal lines including the first gate line GL1 and the second gate line GL2.

Each pixel of the organic light-emitting display device 100 according to an exemplary embodiment may operate in one of an emission mode that is a driving mode for emitting the organic light-emitting diode (OLED) and a sensing mode for compensating for a threshold voltage Vth and/or mobility as characteristic values of the driving transistor DT of each pixel.

Figure 3:
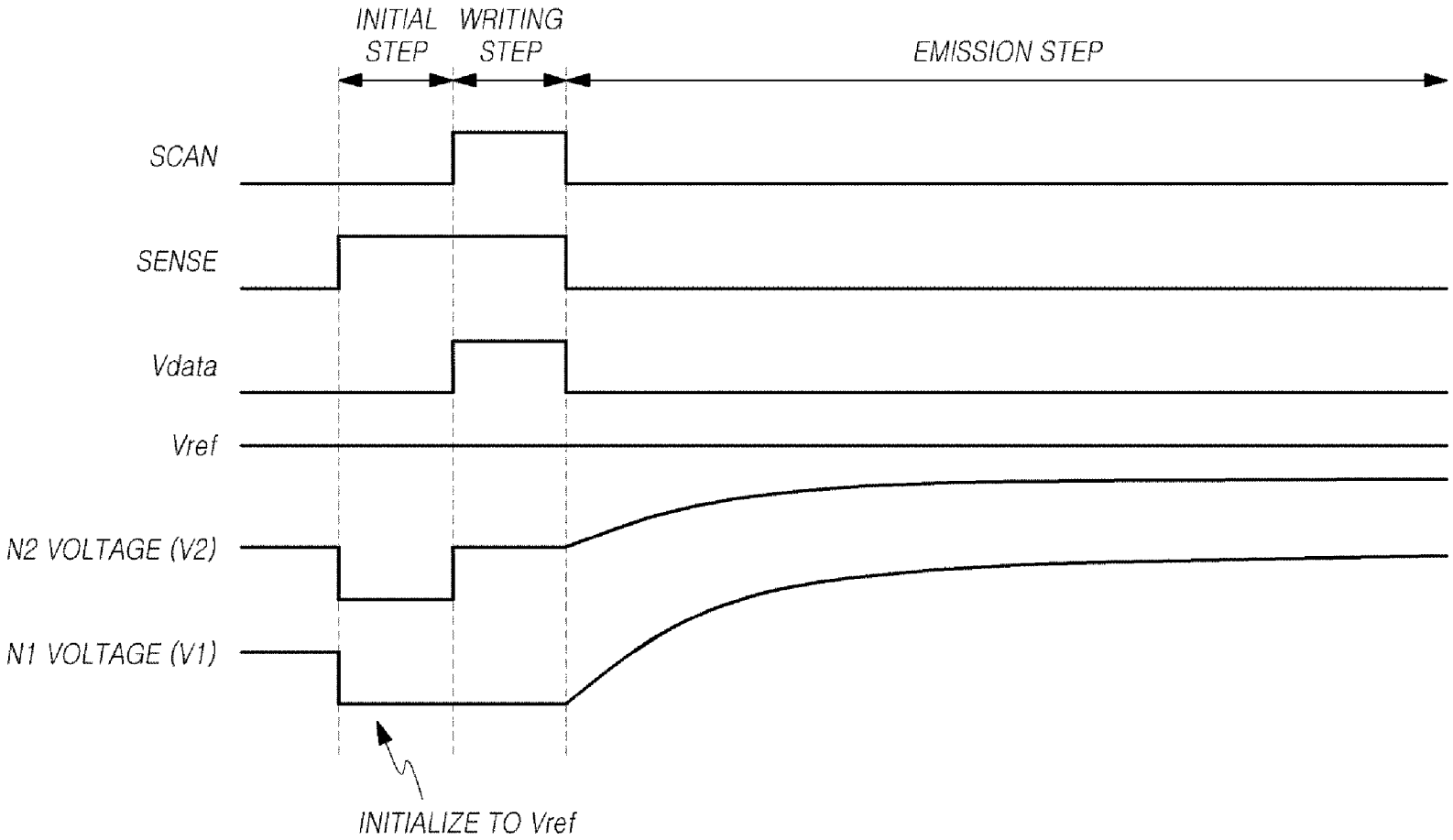
FIG. 3 is a timing diagram of an emission mode of an organic light-emitting display device according to an exemplary embodiment.

When the pixel of the organic light-emitting display device 100 according to an exemplary embodiment is driven in the emission mode, signal waveforms applied to the pixel are illustrated in the timing diagram of FIG. 3.

FIG. 3 is a timing diagram of an emission mode of an organic light-emitting display device 100 according to an exemplary embodiment.

Referring to FIG. 3, the emission mode includes an initial step, a writing step and an emission step.

In the initial step, the first node N1 of the driving transistor DT is initialized. To this end, the reference voltage Vref is applied to the reference voltage line RVL as an initial voltage and the sensing signal SENSE is applied to the first transistor T1, so that the first transistor T1 is turned on. As a result, the reference voltage Vref is applied to the first node N1 of the driving transistor DT. In this case, an initial voltage is determined in consideration of a peak/black current and a voltage that may be output from a data driving integrated circuit (D-IC, also referred to as a source integrated circuit (S-IC)) in the data driver 120.

In the writing step, the scanning signal SCAN is applied to the second transistor T2 to turn on the second transistor T2, so that a data voltage Vdata is applied to the second node N2 of the driving transistor DT. Accordingly, since a predetermined voltage difference (Vdata−Vref) occurs between the second node N2 and the first node N1 of the driving transistor DT, that is, since the predetermined voltage difference (Vdata−Vref) occurs at both ends of the storage capacitor, charge is accumulated in the storage capacitor Cstg based on the predetermined voltage difference.

In the emission step, when the first transistor T1 and the second transistor T2 are simultaneously turned off, the first node N1 and the second node N2 of the driving transistor DT are floated and maintain the predetermined potential difference (Vdata−Vref), so that a voltage is boosted. As a result, when a voltage V1 of the first node N1 of the driving transistor DT increases beyond a predetermined voltage, a current flows through the organic light-emitting diode (OLED) so that the organic light-emitting diode (OLED) emits light.

In a case in which a pixel operates in the sensing mode, referring to FIG. 2, in order to compensate for the threshold voltage Vth and the mobility of the driving transistor DT, a digital-to-analog converter (DAC) of the data driving integrated circuit (D-IC) in the data driver 120 applies the data voltage Vdata to the second node N2 of the driving transistor through the data line, and the reference voltage supply unit 160 applies the reference voltage Vref to the first node N1 of the driving transistor DT through the reference voltage line RVL. Afterwards, when the first node N1 of the driving transistor DT is floated and the voltage of the first node N1 changes and becomes constant, the digital-to-analog converter (DAC) of the data driving integrated circuit (D-IC) in the data driver 120 measures the constant voltage (Vdata-Vth) through the reference voltage line RVL and senses the threshold voltage Vth of the driving transistor DT. The sensed threshold voltage is added to each data voltage so that the threshold voltage can be compensated.

Referring to FIG. 2, the reference voltage line RVL supplying the reference voltage Vref to each pixel may also be formed in correspondence with each pixel array. That is, the reference voltage line RVL may be formed by the same number of data lines.

One reference voltage line RVL supplying the reference voltage Vref to each pixel may also be formed for several pixel arrays. That is, reference voltage lines RVL having a number smaller than the number of the data lines may be formed.

For example, one reference voltage line RVL may be formed for four pixel arrays. In this case, the number of the reference voltage lines is ¼ of the number of the data lines.

The reference voltage line forming structure in which one reference voltage line RVL is formed for four pixel arrays as described above is illustrated in FIG. 4.

Figure 4:
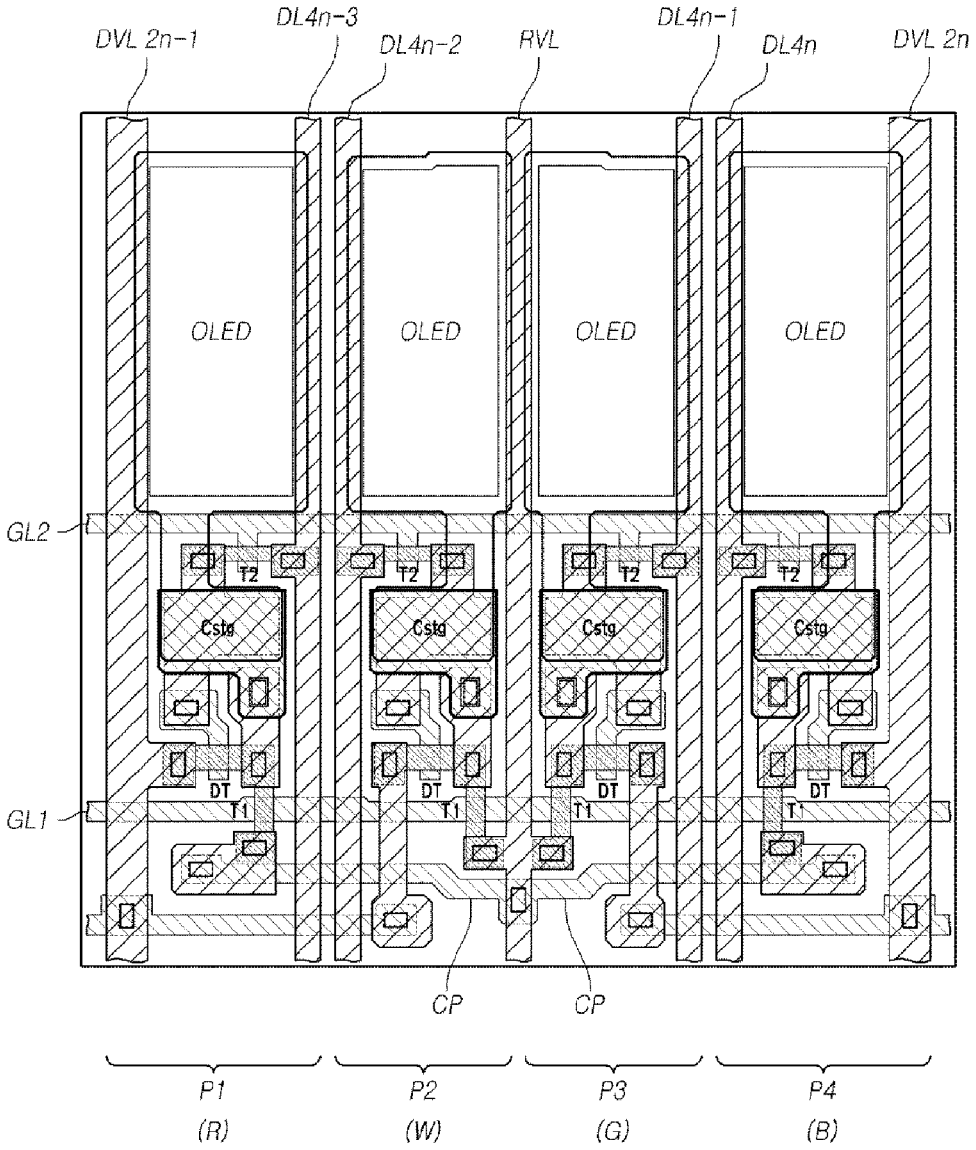
FIG. 4 is a top plan view illustrating a display panel of an organic light-emitting display device according to an exemplary embodiment.

FIG. 4 is a top-plan view illustrating a display panel 110 of an organic light-emitting display device 100 according to an exemplary embodiment.

FIG. 4 illustrates a part of the display panel 110 including four pixels P1 to P4.

Referring to FIG. 4, the four pixels P1 to P4 are configured such that the pixel P1 is connected to a $4n-3^{th}$ data line DL4n−3, the pixel P2 is connected to a $4n-2^{th}$ data line DL4n−2, the pixel P3 is connected to a $4n-1^{th}$ data line DL4n−1, and the pixel P4 is connected to a $4n^{th}$ data line DL4n.

Referring to FIG. 4, one reference voltage line RVL is formed for the four pixels P1 to P4. That is, the number of the data lines is 4 and the number of the reference voltage lines is 1, corresponding to ¼ of the number of the data lines.

Referring to FIG. 4, one reference voltage line RVL is formed between the pixel P2 connected to the $4n-2^{th}$ data line DL4n−2 and the pixel P3 connected to the $4n-1^{th}$ data line DL4n−1, is directly connected to the first transistor T1 of the pixel P2 and the first transistor T1 of the pixel P3, and is connected to the first transistor T1 of the pixel P1 and the first transistor T1 of the pixel P4 through the connection pattern (CP).

Referring to FIG. 4, two driving voltage lines DVL2n−1 and DVL2n are formed at both sides of the four pixels P1 to P4.

Furthermore, referring to FIG. 4, the two data lines DL4n−3 and DL4n−2 for supplying data voltages to the two pixels P1 and P2 are formed between the pixel P1 and the pixel P2, and the two data lines DL4n−1 and DL4n for supplying data voltages to the two pixels P3 and P4 are formed between the pixel P3 and the pixel P4.

As described above, one reference voltage line RVL is formed for four pixels (four pixel arrays) and two driving voltage lines DVL are formed for four pixels, such that it is possible to improve an aperture ratio, as compared with the case in which one reference voltage line RVL is formed one pixel (one pixel array) and one driving voltage line DVL is formed one pixel (one pixel array).

Furthermore, in the four pixel structure, the arrangement structure of the two driving voltage lines DVL2n−1 and DVL2n and the four data lines DL4n−3, DL4n−2, DL4n−1 and DL4n is symmetrical to the arrangement structure of the three transistors DT, T1 and T2 and the one capacitor Cstg in each pixel about the one reference voltage line RVL.

In addition, such a symmetrical structure is repeatedly formed for every four pixels, such that it is possible to easily manufacture the display panel 110.

The structure of the display panel 110 illustrated in FIG. 4 may be a structure suitable for a display panel in which pixels are patterned to represent WRGB. That is, the pixels P1 to P4 may be WRGB pixels.

As described above, in an exemplary embodiment, only one reference voltage line RVL is formed for four pixel arrays in the display panel 110 to be shared by the four pixel arrays, and the reference voltage line sharing structure of directly connecting one reference voltage line RVL formed for the four pixel arrays to the data driving integrated circuit is provided, such that it is possible to improve an aperture ratio and reduce the number of contacts between the data driving integrated circuit and the reference voltage lines RVL.

However, in such an exemplary embodiment, different types of metal signal lines (connection patterns CP) and contact holes may be required in order that four pixels share one reference voltage line RVL. This may cause reduction of an aperture ratio and an increase in defects due to overlaps between the metal lines.

Furthermore, since it may be necessary to connect the data driving integrated circuit to the reference voltage lines RVL and an area for configuring a voltage applying circuit may be separately required, the number of contact pins is slightly increased and the area of the data driving integrated circuit is widened, resulting in an increase in the circuit manufacturing cost.

In order to further improve the organic light-emitting display device 100 described above, an organic light-emitting display device according to another exemplary embodiment will now be described with reference to FIG. 5 to FIG. 26, which has a novel pixel structure with no reference voltage line RVL.

Figure 5:
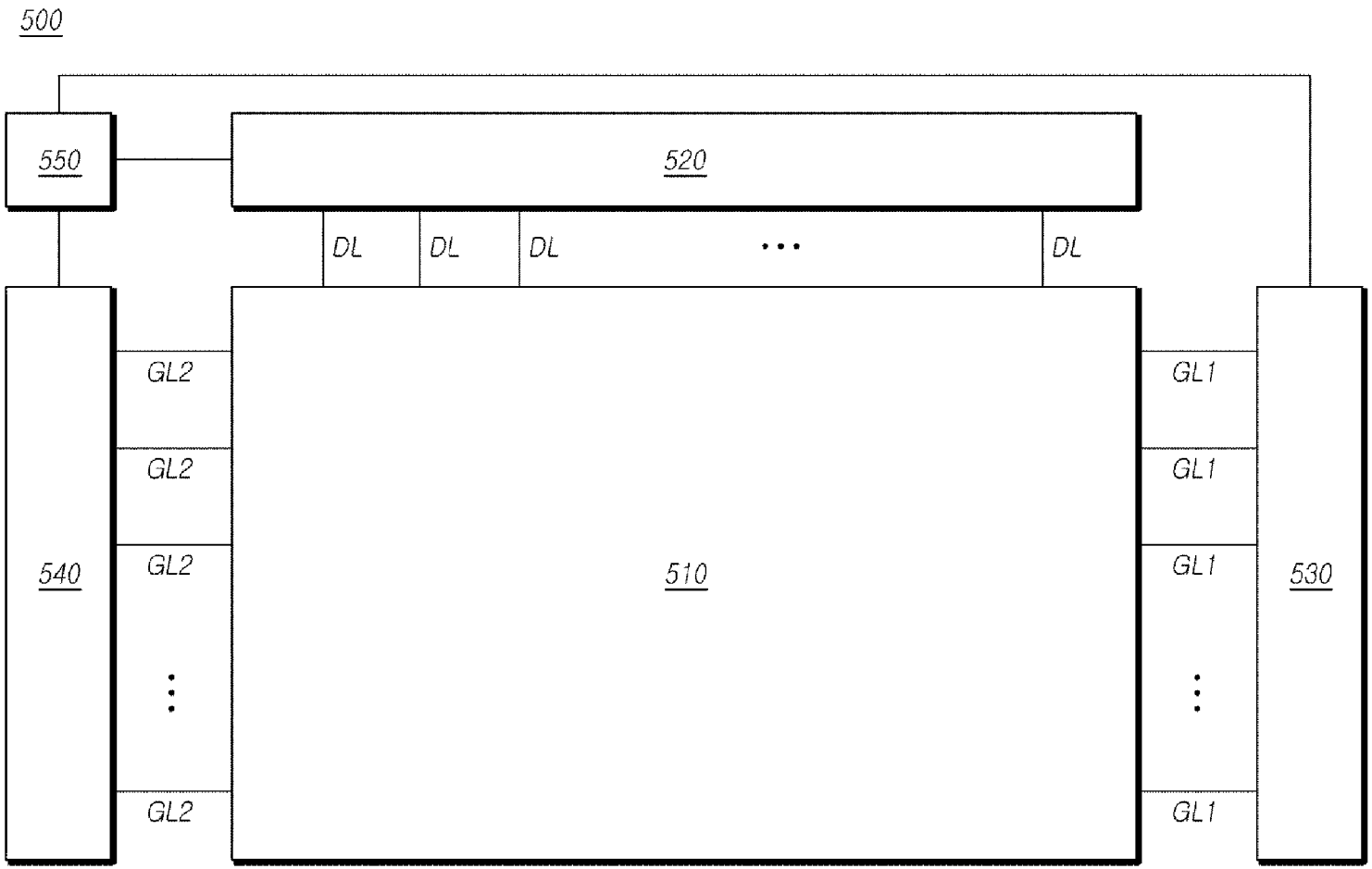
FIG. 5 is a diagram illustrating a system of an organic light-emitting display device according to another exemplary embodiment.

FIG. 5 is a diagram illustrating a system of an organic light-emitting display device 500 according to another exemplary embodiment.

Referring to FIG. 5, the organic light-emitting display device 500 includes a display panel 510 in which a plurality of data lines DL, a plurality of first gate lines GL1 and a plurality of second gate lines GL2 are formed and a plurality of pixels P are defined, a data driver 520 that drives the plurality of data lines DL formed in one direction on the display panel 510, a first gate driver 530 that supplies a sensing signal through the first gate lines GL1 formed in another direction and crossing the data lines DL on the display panel 510, a second gate driver 540 that supplies a scanning signal through the second gate lines GL2 formed in parallel with the first gate lines GL1 on the display panel 510, and a timing controller 550 that controls the driving timings of the data driver 520, the first gate driver 530 and the second gate driver 540.

Referring to FIG. 5, the organic light-emitting display device 500 does not include the reference voltage supply unit, which is different from the organic light-emitting display device 100 illustrated in FIG. 1.

Furthermore, in the display panel 510 of the organic light-emitting display device 500, the reference voltage line RVL is not formed, which is also different from the display panel 110 of the organic light-emitting display device 100 illustrated in FIG. 1.

The first gate driver 530 and the second gate driver 540 may be separately provided, and may also be included in one gate driver as desired.

The first gate driver 530 may be positioned only at one side of the display panel 510 as illustrated in FIG. 5 or may be divided into two and positioned at both sides of the display panel 510 depending on a driving scheme. Similarly, the second gate driver 540 may also be variously positioned.

Each of the first gate driver 530 and the second gate driver 540 may include a plurality of gate driving integrated circuits. Such gate driving integrated circuits may be connected to bonding pads of the display panel 510 by using a tape automated bonding (TAB) method or a chip on glass (COG) method, or may be provided in a gate in panel (GIP) type directly formed on the display panel 510. Furthermore, the first gate driver 530 and the second gate driver 540 may be integrated with the display panel 510.

The data driver 520 may include a plurality of data driving integrated circuits (also referred to as source driving integrated circuits). Such data driving integrated circuits may be connected to bonding pads of the display panel 510 by using the tape automated bonding (TAB) method or the chip on glass (COG) method, or may be directly formed on the display panel 510. Furthermore, the data driver 520 may be integrated with the display panel 510.

A pixel structure of each pixel P defined in the display panel 510 of the organic light-emitting display device 500 according to another exemplary embodiment will be described with reference to FIG. 6.

Figure 6:
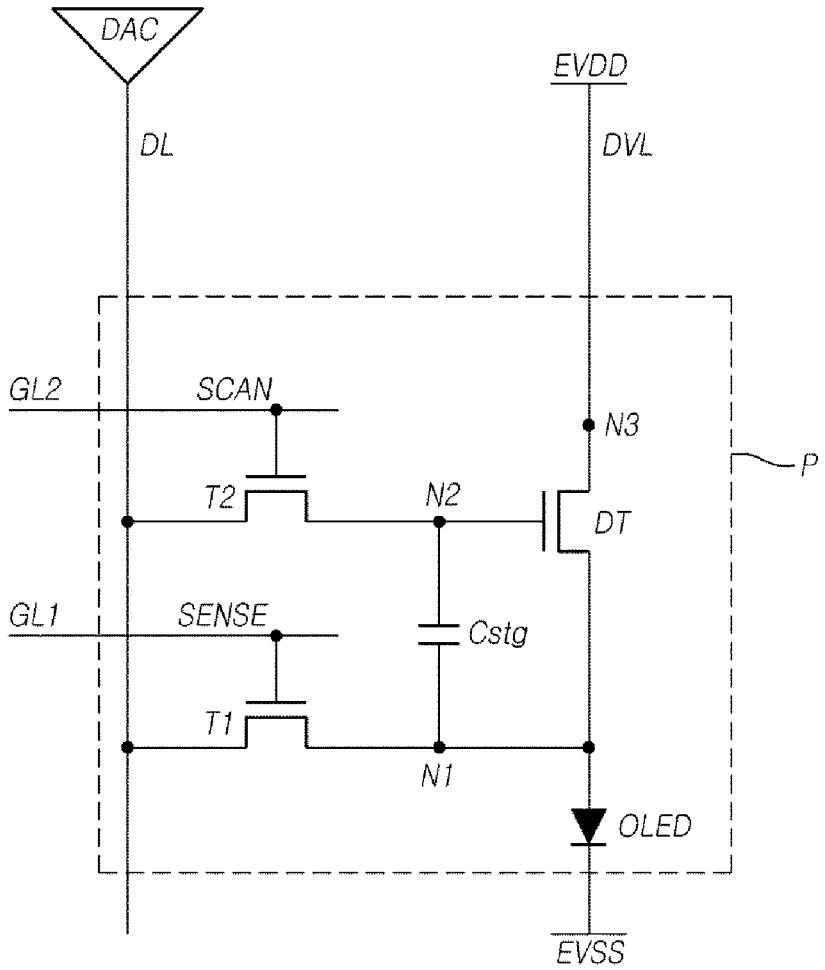
FIG. 6 is an equivalent circuit diagram illustrating a pixel structure of an organic light-emitting display device according to another exemplary embodiment.

FIG. 6 is an equivalent circuit diagram illustrating a pixel structure of an organic light-emitting display device 500 according to another exemplary embodiment.

Referring to FIG. 6, each pixel defined in the display panel 510 of the organic light-emitting display device 500 according to another exemplary embodiment includes an organic light-emitting diode (OLED), a driving transistor DT, a first transistor T1, a second transistor T2, a storage capacitor Cstg, and the like. The driving transistor DT has a first node N1, a second node N2 and a third node N3. The first transistor T1 is controlled by the sensing signal SENSE supplied through the first gate line GL1 and is connected between the data line DL and the first node N1 of the driving transistor DT. The second transistor T2 is controlled by the scanning signal SCAN supplied through the second gate line GL2 and is connected between the same data line DL connected to the first transistor T1 and the second node N2 of the driving transistor DT. The storage capacitor Cstg is connected between the first node N1 and the second node N2 of the driving transistor DT.

The driving transistor DT in each pixel P is a transistor that receives a driving voltage EVDD supplied by a driving voltage line DVL, is controlled by a voltage (a data voltage) of the second node N2 applied through the second transistor T2, and drives the organic light-emitting diode (OLED).

Such a driving transistor DT has the first node N1 to which the reference voltage Vref is applied through the first transistor T1, the second node N2 to which the data voltage Vdata is applied through the second transistor T2 and the third node N3 connected to the driving voltage line DVL. The first node N1 is connected to the first transistor T1, the second node N2 is connected to the second transistor T2, and the third node N3 receives the driving voltage EVDD.

In an example, the first node of the driving transistor DT may be referred to as a source node (also referred to as a "source electrode"), the second node may be referred to as a gate node (also referred to as a "gate electrode"), and the third node N3 may be referred to as a drain node (also referred to as a "drain electrode"). The first node and the third node of the driving transistor DT may also be a drain node and a source node according to a circuit implementation scheme or a circuit state.

The first transistor T1 is a transistor that is controlled by the sensing signal SENSE supplied through the first gate line GL1, is connected between the data line DL and the first node N1 of the driving transistor DT, and is concerned in a sensing mode, and is also referred to as a "sensor transistor."

The second transistor T2 is a transistor that is controlled by the scanning signal SCAN supplied through the second gate line GL2, is connected between a corresponding data line DL and the second node N2 of the driving transistor DT, and switches a data voltage to be applied to the second node N2 of the driving transistor DT, and is also referred to as a "switching transistor."

The storage capacitor Cstg is connected between the first node N1 and the second node N2 of the driving transistor DT, and maintains the data voltage during one frame.

As illustrated in FIG. 6, each pixel defined in the display panel 510 of the organic light-emitting display device 500 has a 3T1C structure including the three transistors DT, T1 and T2 and the one capacitor Cstg.

Furthermore, as illustrated in FIG. 6, each pixel defined in the display panel 510 of the organic light-emitting display device 500 according to another exemplary embodiment requires two vertical signal lines including the data line DL and the driving voltage line DVL and two horizontal signal lines including the first gate line GL1 and the second gate line GL2.

That is, each pixel defined in the display panel 510 of the organic light-emitting display device 500 does not include the reference voltage line RVL illustrated in FIG. 2 that is a separate signal line for supplying the reference voltage Vref as an initial voltage in order to initialize the first node N1 of the driving transistor DT.

Instead, the pixel in the display panel 510 uses the existing data line DL, which supplies the data voltage Vdata, as a signal line for supplying the reference voltage Vref.

Accordingly, the data line DL may operate as a signal line for supplying the reference voltage Vref or a signal line for supplying the data voltage Vdata depending on an operation timing of the corresponding pixel.

As described above, each pixel defined in the display panel 510 of the organic light-emitting display device 500 is similar to each pixel defined in the display panel 110 of the organic light-emitting display device 100 illustrated in FIG. 2 in that each pixel has a 3T1C pixel structure, but is different as far as required signal lines are concerned.

Through such differences, driving methods for the pixel of the organic light-emitting display device 500 in an emission mode and a sensing mode are different from those of the pixel of the organic light-emitting display device 100.

Hereinafter, a driving method for a pixel of an organic light-emitting display device 500 according to another exemplary embodiment in an emission mode will be described in detail with reference to FIG. 7 to FIG. 10, and a driving method for a pixel of an organic light-emitting display device 500 according to another exemplary embodiment in a sensing mode will be described in detail with reference to FIG. 11 to FIG. 25.

Figure 7:
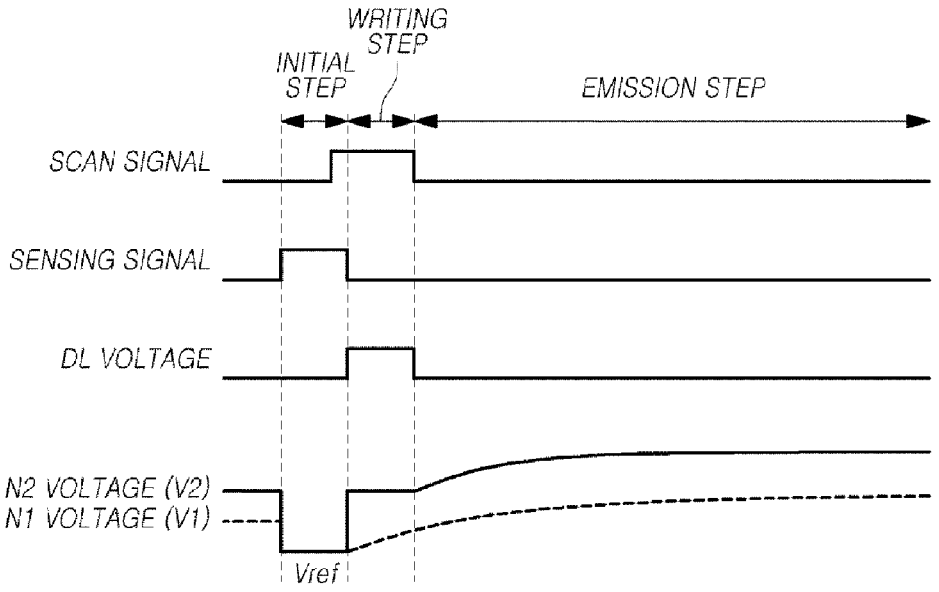
FIG. 7 is a timing diagram of an emission mode of an organic light-emitting display device according to another exemplary embodiment.

FIG. 7 is a timing diagram of an emission mode of an organic light-emitting display device 500 according to another exemplary embodiment.

Referring to the circuit diagram of FIG. 6 and the timing diagram of FIG. 7, in a case in which a pixel operates in the emission mode, the first transistor T1 included in the corresponding pixel is turned on by the sensing signal SENSE and the reference voltage Vref is output to the data line DL, so that the reference voltage Vref is applied to the second node N2 of the driving transistor DT as an initial voltage.

Thereafter, the first transistor T1 is turned off, the second transistor T2 is turned on by the scanning signal SCAN, and the data voltage Vdata is output to the data line DL, so that the data voltage Vdata is applied to the first node N1 of the driving transistor DT having the second node N2 to which the reference voltage has been applied. Afterwards, a predetermined voltage (a voltage capable of allowing a current to flow through the organic light-emitting diode (OLED)) is applied between the second node N2 and the first node N1 of the driving transistor DT and a current flows through the organic light-emitting diode (OLED), so that the organic light-emitting diode (OLED) emits light.

Such an emission mode includes an initial step, a writing step and an emission step as illustrated in FIG. 7.

Signal waveforms and operations of the transistors in each step included in the emission mode will be described in detail with reference to FIG. 8 to FIG. 10.

Figure 8:
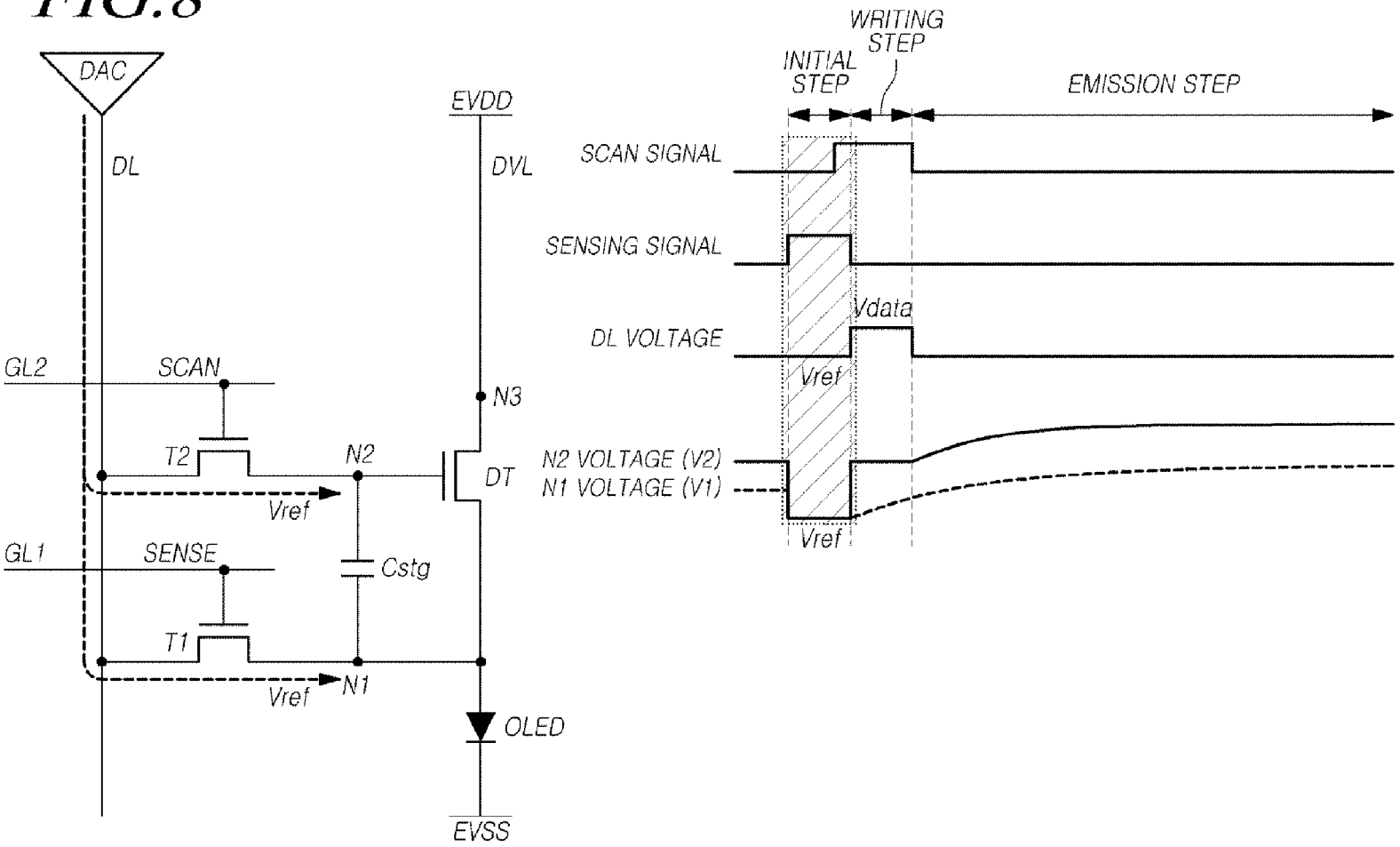
FIG. 8 to FIG. 10 are operation circuit diagrams according to steps of an emission mode of an organic light-emitting display device according to another exemplary embodiment.
Figure 9:
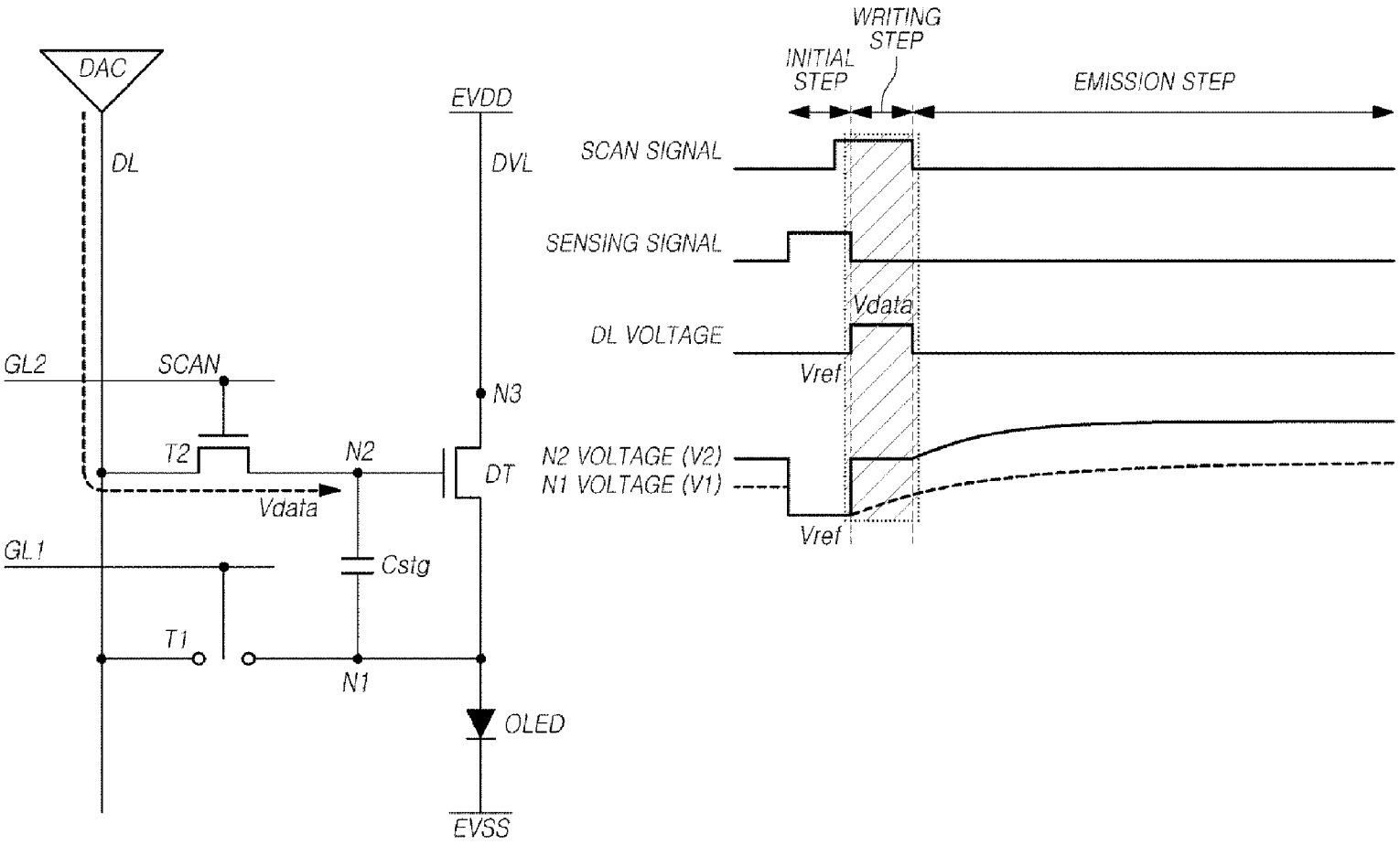
Figure 10:
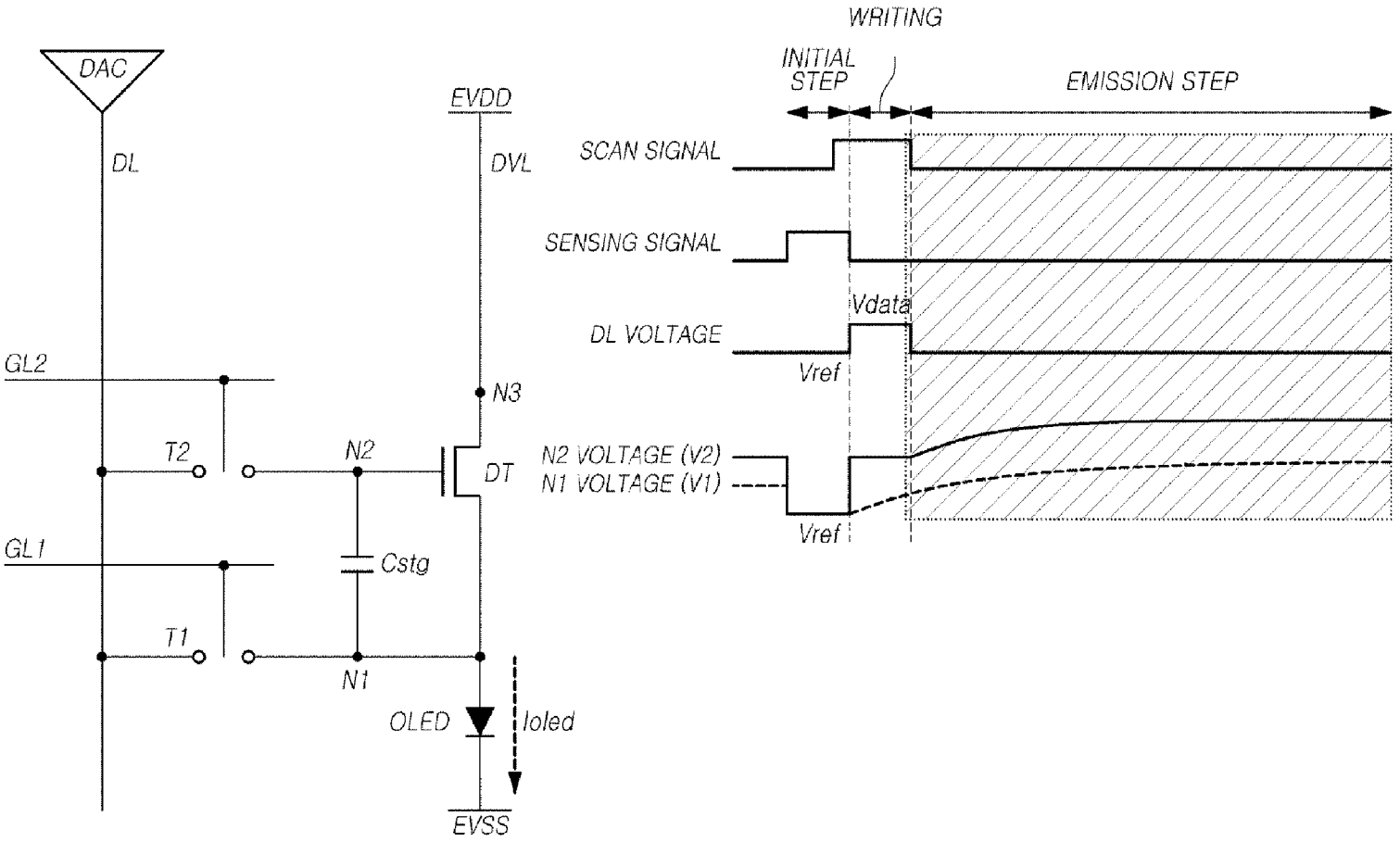

FIG. 8 to FIG. 10 are operation circuit diagrams according to steps of the emission mode of the organic light-emitting display device 500 according to another exemplary embodiment.

With reference to FIG. 8, the initial step of the emission mode will be described.

Referring to FIG. 8, in the initial step of the emission mode, the first transistor T1 included in a corresponding pixel is turned on by the sensing signal SENSE and the reference voltage Vref applied to the data line DL as an initial voltage is applied to the second node N2 of the driving transistor DT, so that the second node N2 of the driving transistor DT is initialized.

Afterwards, for the purpose of the performance and efficiency of the emission mode, the second transistor T2 is also turned on by the scanning signal SCAN and the reference voltage Vref applied to the data line DL is also applied to the first node N1 of the driving transistor DT, so that the first node N1 of the driving transistor DT is also initialized.

Next, with reference to FIG. 9, the writing step of the emission mode will be described.

Referring to FIG. 9, in the writing step after all the first node N1 and the second node N2 of the driving transistor DT are initialized in the initial step, the sensing signal SENSE drops to a low level to turn off the first transistor T1, and the second transistor T2 is turned on by the scanning signal SCAN, so that the data voltage Vdata supplied to the data line DL is written in (applied to) the first node N1 of the driving transistor DT.

At this time point, a predetermined voltage (Vdata−Vref) is instantaneously applied between the second node N2 and the first node N1 of the driving transistor DT, so that a charge corresponding to this voltage is accumulated in the storage transistor Cstg. However, since the first transistor T1 has been turned off, the first node N1 of the driving transistor DT does not maintain a constant voltage Vref applied before the first transistor T1 is turned off, and is floated.

As a result, the storage transistor Cstg is discharged and the voltage of the first node N1 of the driving transistor DT is boosted. At this time, no current flows through the organic light-emitting diode (OLED) by the threshold voltage of the organic light-emitting diode (OLED).

The voltage of the first node N1 of the driving transistor DT is boosted up to a voltage when a current may flow through organic light-emitting diode (OLED), and the voltage (the potential difference) between the second node N2 and the first node N1 of the driving transistor DT is constantly maintained.

With reference to FIG. 10, the emission step of the emission mode will be described.

Referring to FIG. 10, after the predetermined voltage (the boosted voltage of the first node N1 of the driving transistor DT) is applied between the second node N2 and the first node N1 of the driving transistor DT in the writing step, in the emission step starting from that time point, since all the first transistor T1 and the second transistor T2 are turned off, all the second node N2 and the first node N1 of the driving transistor DT are floated, so that voltage boosting occurs and thus a current Ioled flows through organic light-emitting diode (OLED).

So far, the emission mode has been described, and the sensing mode will be described below.

The sensing mode of the organic light-emitting display device 500 according to another exemplary embodiment may be classified into a sensing mode based on voltage sensing and a sensing mode based on current sensing.

The sensing mode based on voltage sensing may be classified into a threshold voltage sensing mode and a mobility sensing mode, and in the sensing mode based on current sensing, the threshold voltage sensing mode and the mobility sensing mode are not separately performed and are performed at a time, such that it is possible to simultaneously calculate a threshold voltage and mobility.

In any sensing mode, the organic light-emitting display device 500 according to another exemplary embodiment may further include a sensing unit (1100 of FIG. 11 and 2100 of FIG. 21) for sensing one or more of the threshold voltage and the mobility of the driving transistor DT.

Such a sensing unit is connected to the driving voltage line DVL connected to the third node N3 of the driving transistor DT.

This is different from the organic light-emitting display device 100 in that the sensing unit (including the ADC and the like of FIG. 2) is connected to the reference voltage line RVL.

Hereinafter, a circuit for the sensing mode based on voltage sensing will be described with reference to FIG. 11, the threshold voltage sensing mode of the sensing mode based on voltage sensing will be described with reference to FIG. 12 to FIG. 15, and the mobility sensing mode of the sensing mode based on voltage sensing will be described with reference to FIG. 16 to FIG. 20. Afterwards, a circuit for the sensing mode based on current sensing will be described with reference to FIG. 21, and the sensing of a threshold voltage and mobility through the sensing mode based on current sensing will be described with reference to FIG. 22 to FIG. 25.

Figure 11:
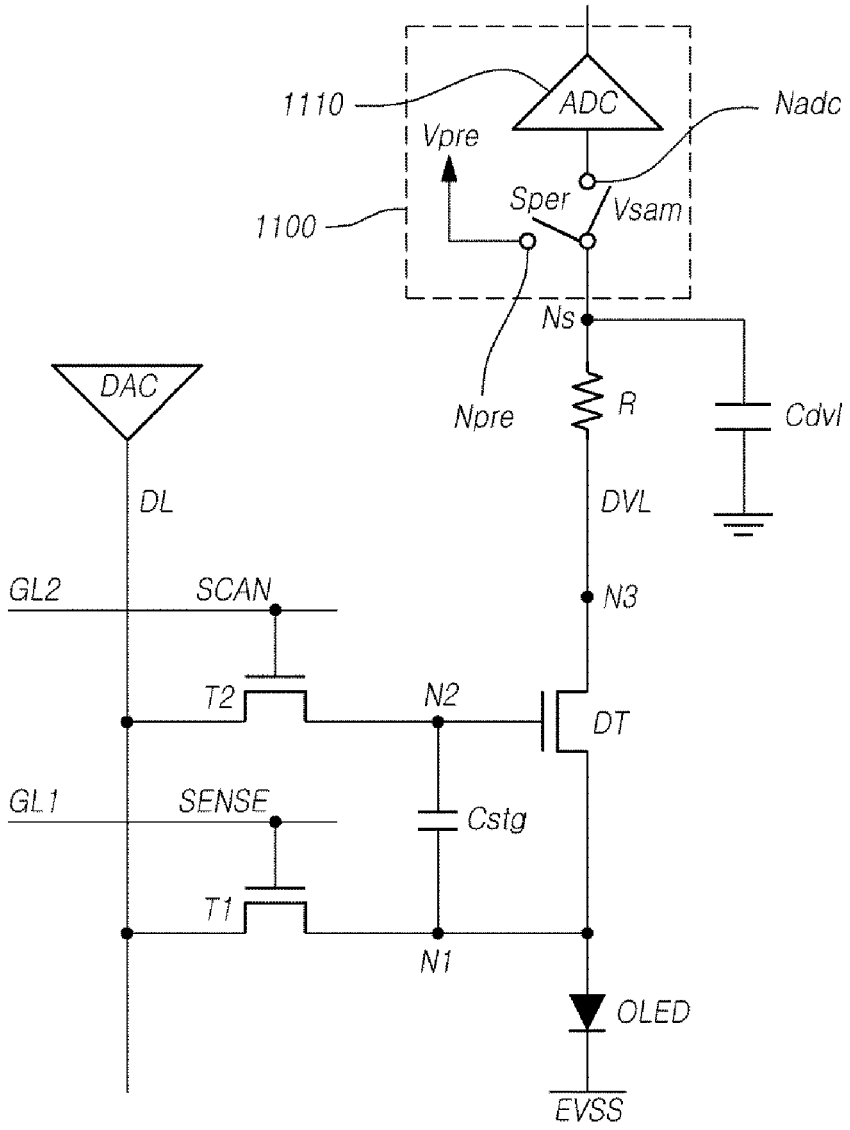
FIG. 11 is a circuit diagram illustrating a case in which a pixel of an organic light-emitting display device according to another exemplary embodiment operates in a sensing mode based on voltage sensing.

FIG. 11 is a circuit diagram illustrating a case in which a pixel of an organic light-emitting display device 500 according to another exemplary embodiment operates in a sensing mode based on voltage sensing.

Referring to FIG. 11, in the organic light-emitting display device 500, a circuit for the sensing mode based on voltage sensing further includes the sensing unit 1100 connected to the driving voltage line DVL, which is an addition to the pixel structure illustrated in FIG. 6.

Referring to FIG. 11, the sensing unit 1100 for the sensing mode based on voltage sensing includes an analog-to-digital converter 1110 that measures a voltage of a sensing node Ns connected to the driving voltage line DVL, a first switch Sper that switches a connection between a precharge voltage supply node Npre and the sensing node Ns, and a second switch Vsam that switches a connection between a connection node Nadc of the analog-to-digital converter 1110 and the sensing node Ns.

When the first switch Sper is turned on, the precharge voltage supply node Npre and the sensing node Ns are connected to each other, and when the first switch Sper is turned off, the precharge voltage supply node Npre and the sensing node Ns are not connected to each other. When the second switch Vsam is turned on, the connection node Nadc of the analog-to-digital converter 1110 and the sensing node Ns are connected to each other, and when the second switch Vsam is turned off, the connection node Nadc of the analog-to-digital converter 1110 and the sensing node Ns are not connected to each other.

Furthermore, referring to FIG. 11, a resistor R may be connected between the driving voltage line DVL and the sensing node Ns, and a driving voltage line capacitor Cdvl may be formed in the driving voltage line DVL.

Hereinafter, the threshold voltage sensing mode will be described with reference to FIG. 12 to FIG. 15 on the basis of the circuit for the sensing mode based on voltage sensing illustrated in FIG. 11.

Figure 12:
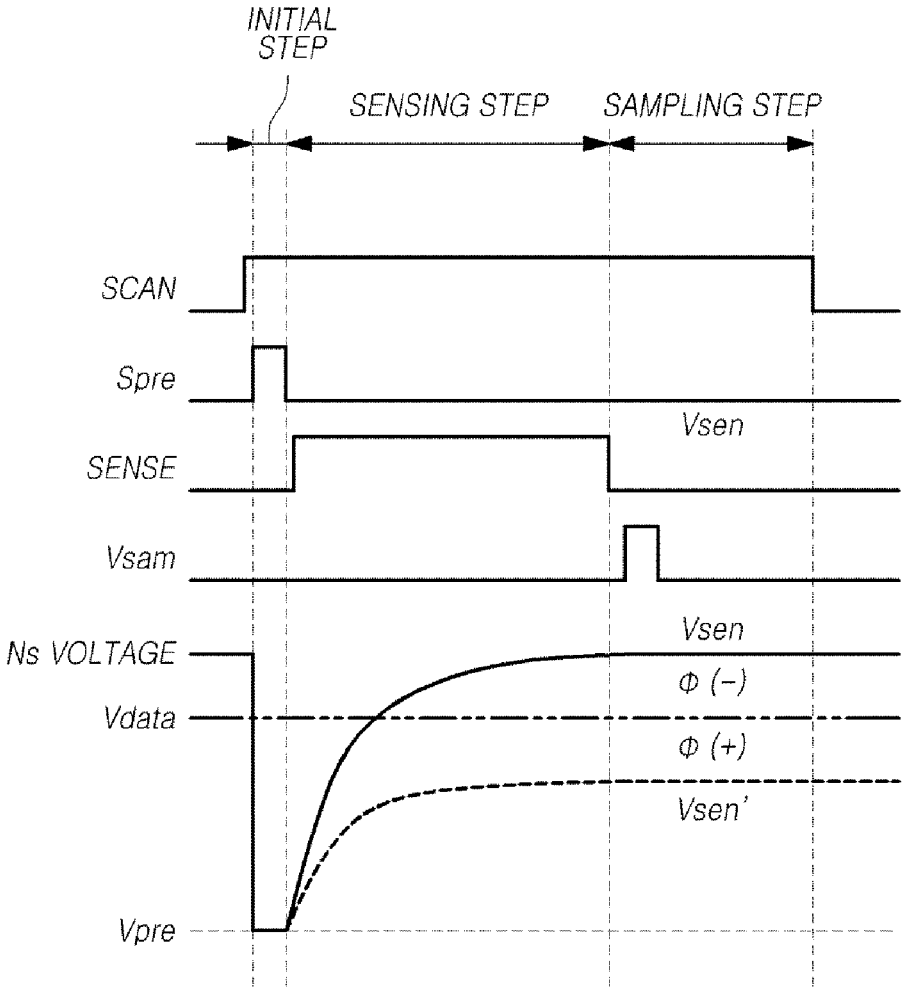
FIG. 12 is a timing diagram illustrating a case in which a pixel of an organic light-emitting display device according to another exemplary embodiment operates in a threshold voltage sensing mode of a sensing mode based on voltage sensing.

FIG. 12 is a timing diagram illustrating a case in which a pixel of an organic light-emitting display device 500 according to another exemplary embodiment operates in a threshold voltage sensing mode of a sensing mode based on voltage sensing.

Referring to FIG. 12, the threshold voltage sensing mode of the sensing mode based on voltage sensing includes an initial step, a sensing step and a sampling step.

Hereinafter, signal waveforms and operations according to each step will be described with reference to FIG. 13 to FIG. 15.

Figure 13:
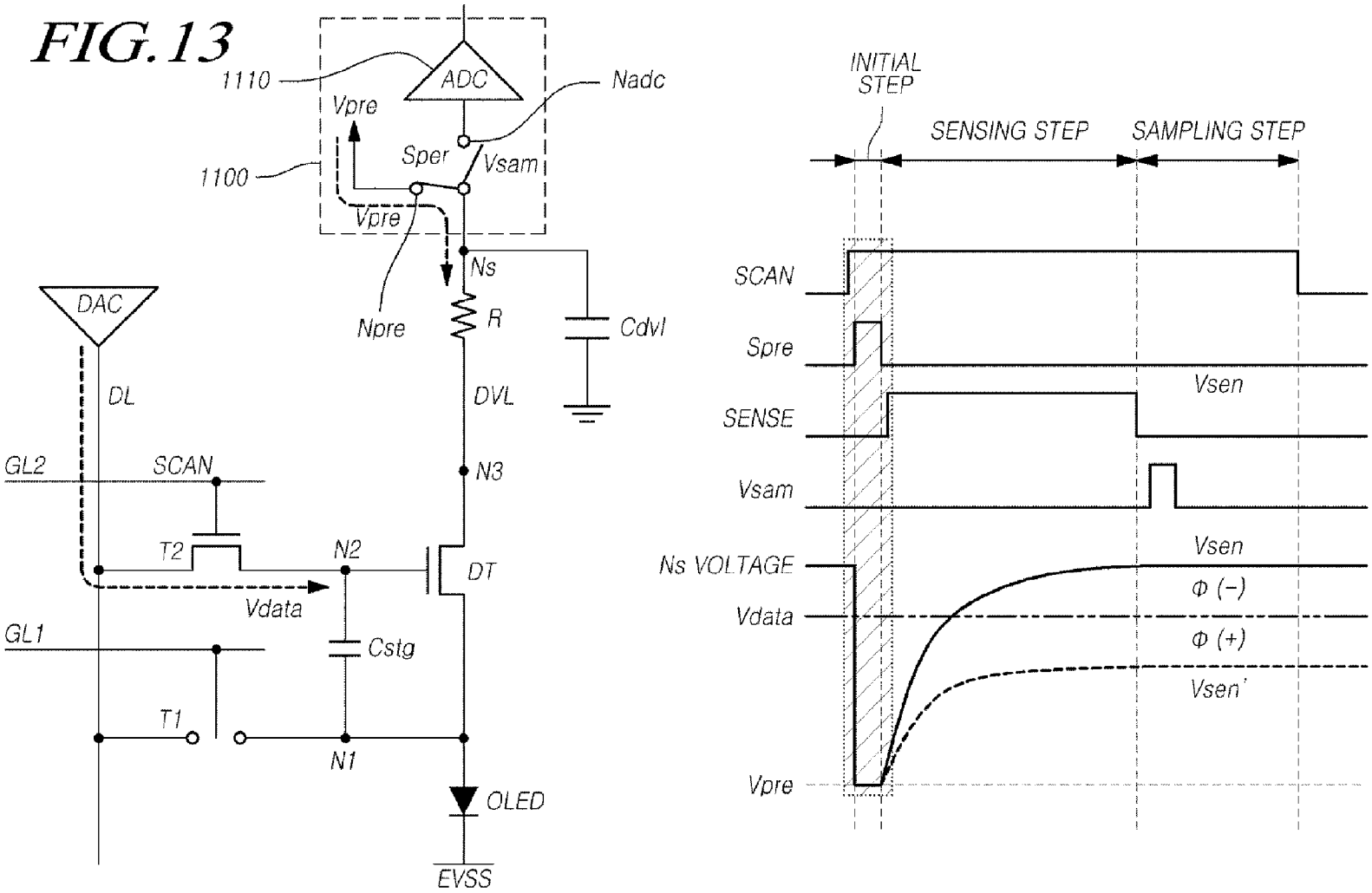
FIG. 13 to FIG. 15 are operation circuit diagrams according to steps when a pixel of an organic light-emitting display device according to another exemplary embodiment operates in a threshold voltage sensing mode of a sensing mode based on voltage sensing.

With reference to FIG. 13, the initial step of the threshold voltage sensing mode based on voltage sensing will be described.

Referring to FIG. 13, in the initial step of the threshold voltage sensing mode based on voltage sensing, the first switch Sper is turned on, so that a precharge voltage Vpre is applied to the sensing node Ns.

At this time, the second transistor T2 is turned on by the scanning signal SCAN, so that the data voltage Vdata supplied through the data line DL is applied to the second node N2 of the driving transistor DT.

Next, with reference to FIG. 14, the sensing step of the threshold voltage sensing mode based on voltage sensing will be described.

Figure 14:
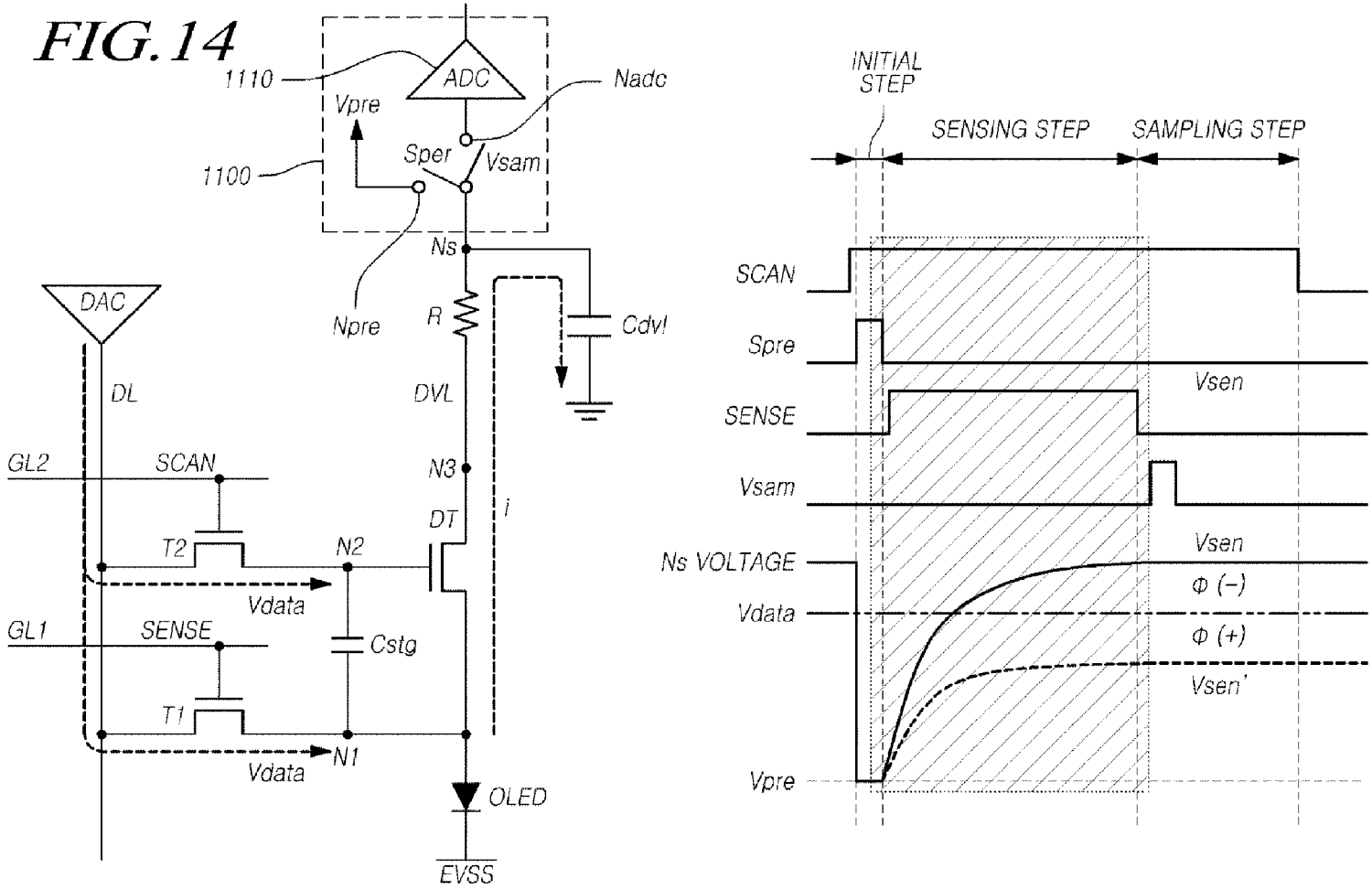

Referring to FIG. 14, in the sensing step of the threshold voltage sensing mode based on voltage sensing, the first switch Sper is turned off and the first transistor T1 is turned on by the sensing signal SENSE, so that the data voltage Vdata supplied through the data line DL is applied to the first node N1 of the driving transistor DT. That is, the same data voltage Vdata is applied to the first node N1 and the second node N2 of the driving transistor DT.

Accordingly, a current i flows through the driving voltage line capacitor Cdvl via the sensing node Ns through the driving transistor DT, and the driving voltage line capacitor Cdvl is charged, so that a voltage of the sensing node Ns rises.

An increase in the voltage of the sensing node Ns starts from the precharge voltage Vpre and stops at a predetermined voltage by the threshold voltage Vth of the driving transistor DT.

Next, with reference to FIG. 15, the sampling step of the threshold voltage sensing mode based on voltage sensing will be described.

Figure 15:
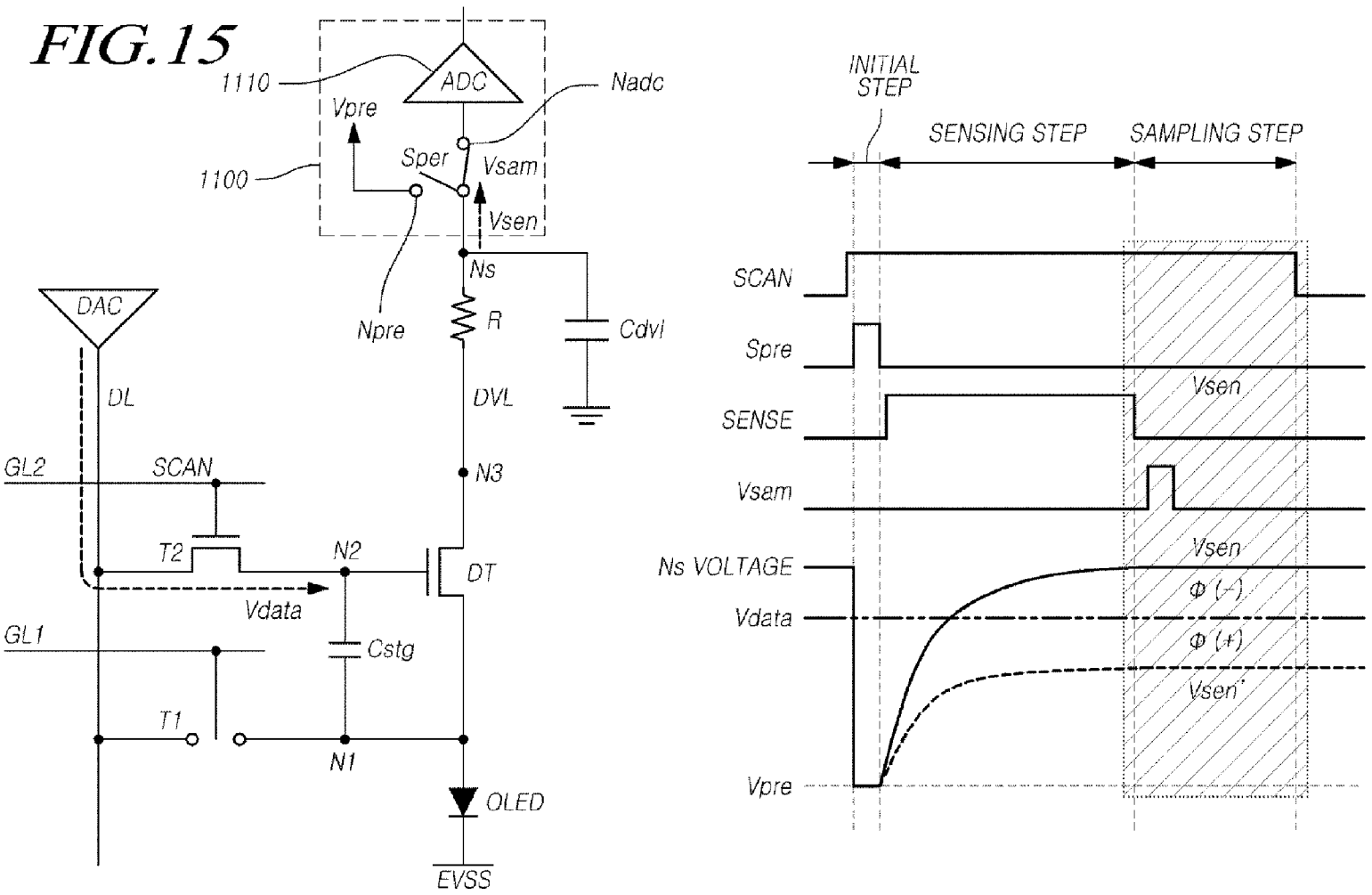

Referring to FIG. 15, in the sampling step of the threshold voltage sensing mode based on voltage sensing, the sensing signal SENSE changes to a low level, so that the first transistor T1 is turned off and the second transistor T2 is turned on.

Accordingly, the analog-to-digital converter 1110 senses the voltage (Vsen or Vsen') of the sensing node Ns that stays at the predetermined voltage after the stopping of the increase.

In the timing diagram of FIG. 15, two lines (a solid line and a dotted line) representing the voltage of the sensing node Ns indicate a case in which the threshold voltage is (−) and a case in which the threshold voltage is (+), respectively. When the threshold voltage is (−), the voltage Vsen of the sensing node Ns is Vdata+Vth in the sampling step, and when the threshold voltage is (+), the voltage Vsen' of the sensing node Ns is Vdata-Vth in the sampling step.

At this case, since the data voltage Vdata is a well-known value, it is possible to obtain the threshold voltage Vth of the driving transistor DT from the measured sensing voltage (Vsen or Vsen').

The timing controller 550 adds the obtained threshold voltage Vth to a next data voltage Vdata to be applied to a corresponding pixel or subtracts the obtained threshold voltage Vth from the next data voltage Vdata to be applied to the corresponding pixel, and converts data to be applied to the corresponding pixel, thereby compensating for the threshold voltage.

Hereinafter, the mobility sensing mode will be described with reference to FIG. 16 to FIG. 20 on the basis of the circuit for the sensing mode based on voltage sensing illustrated in FIG. 11.

Figure 16:
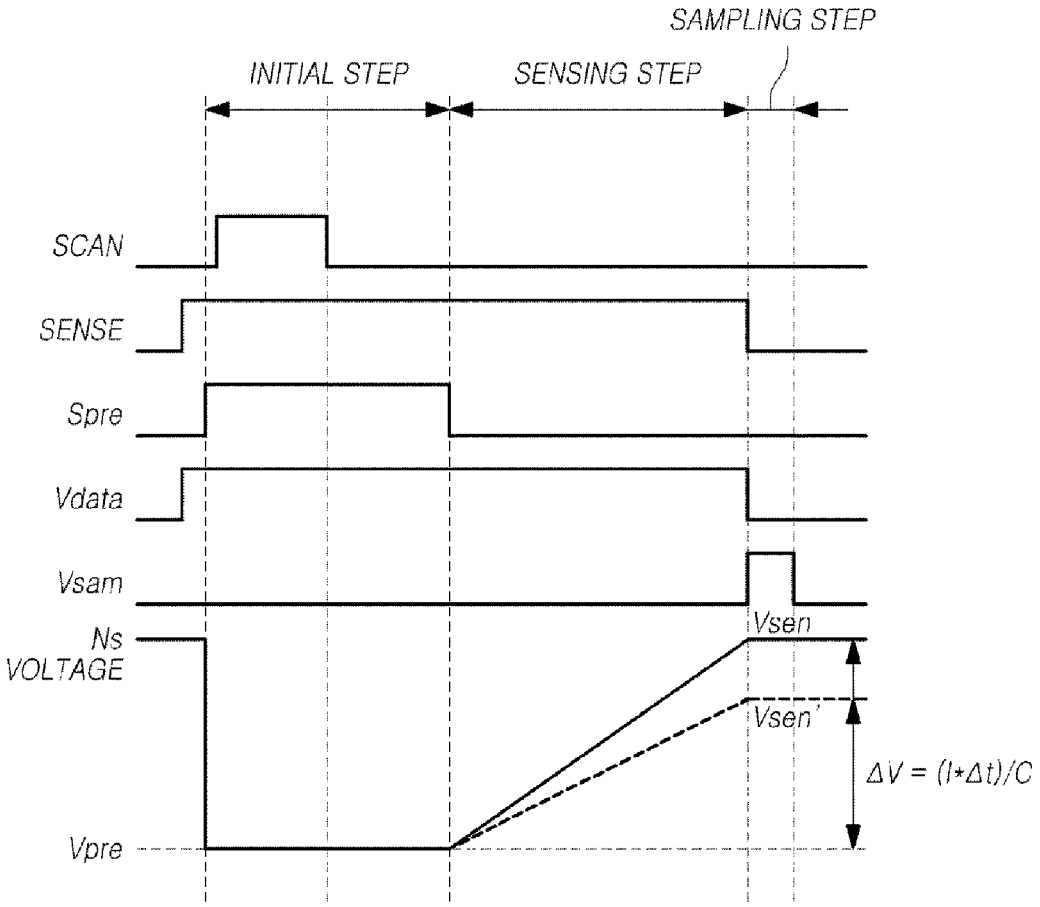
FIG. 16 is a timing diagram illustrating a case in which a pixel of an organic light-emitting display device according to another exemplary embodiment operates in a mobility sensing mode of a sensing mode based on voltage sensing.

FIG. 16 is a timing diagram illustrating a case in which a pixel of an organic light-emitting display device 500 according to another exemplary embodiment operates in a mobility sensing mode of a sensing mode based on voltage sensing.

Referring to FIG. 16, the mobility sensing mode based on voltage sensing includes an initial step, a sensing step and a sampling step, and the mobility sensing is performed in such a manner that the second transistor T2 is turned on by the scanning signal SCAN to apply the data voltage Vdata to the second node N2 of the driving transistor DT, the second transistor T2 is turned off to allow a constant current to flow from the first node N1 of the driving transistor DT to the driving voltage line DVL, and the voltage Vsen accumulated in the driving voltage line capacitor Cdvl formed in the driving voltage line DVL is measured.

FIG. 17 to FIG. 20 are operation circuit diagrams according to steps when a pixel of an organic light-emitting display device 500 according to another exemplary embodiment operates in a mobility sensing mode of a sensing mode based on voltage sensing.

The initial step of the mobility sensing mode based on voltage sensing includes a first initial step in which the second transistor T2 is turned on by the scanning signal SCAN and a second initial step in which the second transistor T2 is turned off.

Figure 17:
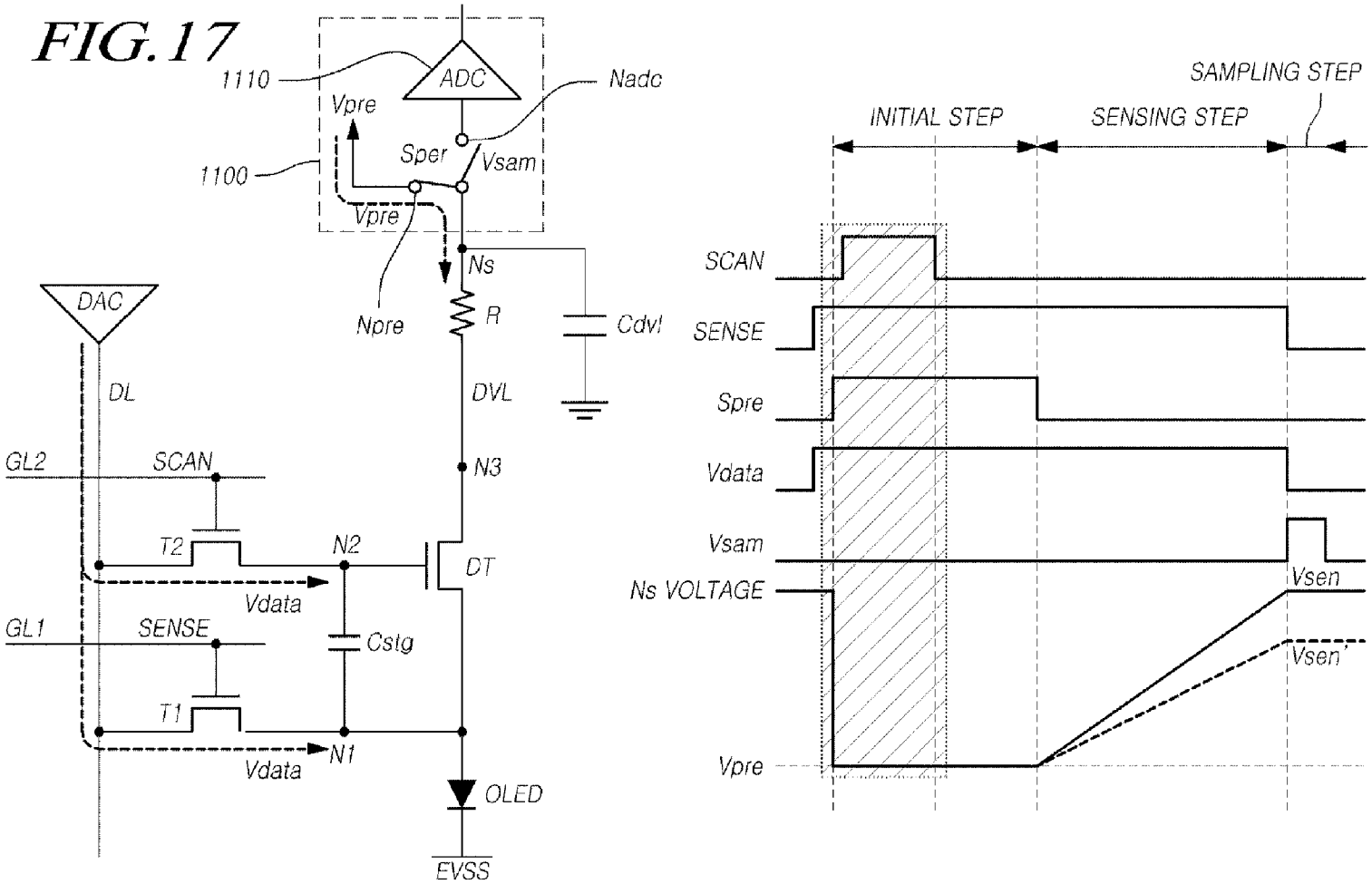
FIG. 17 to FIG. 20 are operation circuit diagrams according to steps when a pixel of an organic light-emitting display device according to another exemplary embodiment operates in a mobility sensing mode of a sensing mode based on voltage sensing.

Referring to FIG. 17, in the first initial step of the mobility sensing mode based on voltage sensing, the second transistor T2 is turned on by the scanning signal SCAN and the first transistor T1 is turned on by the sensing signal SENSE, so that the data voltage Vdata is applied to the second node N2 and the first node N1 of the driving transistor DT.

Referring to FIG. 17, the first switch Sper is turned on, so that the precharge voltage Vpre is applied to the sensing node Ns.

Figure 18:
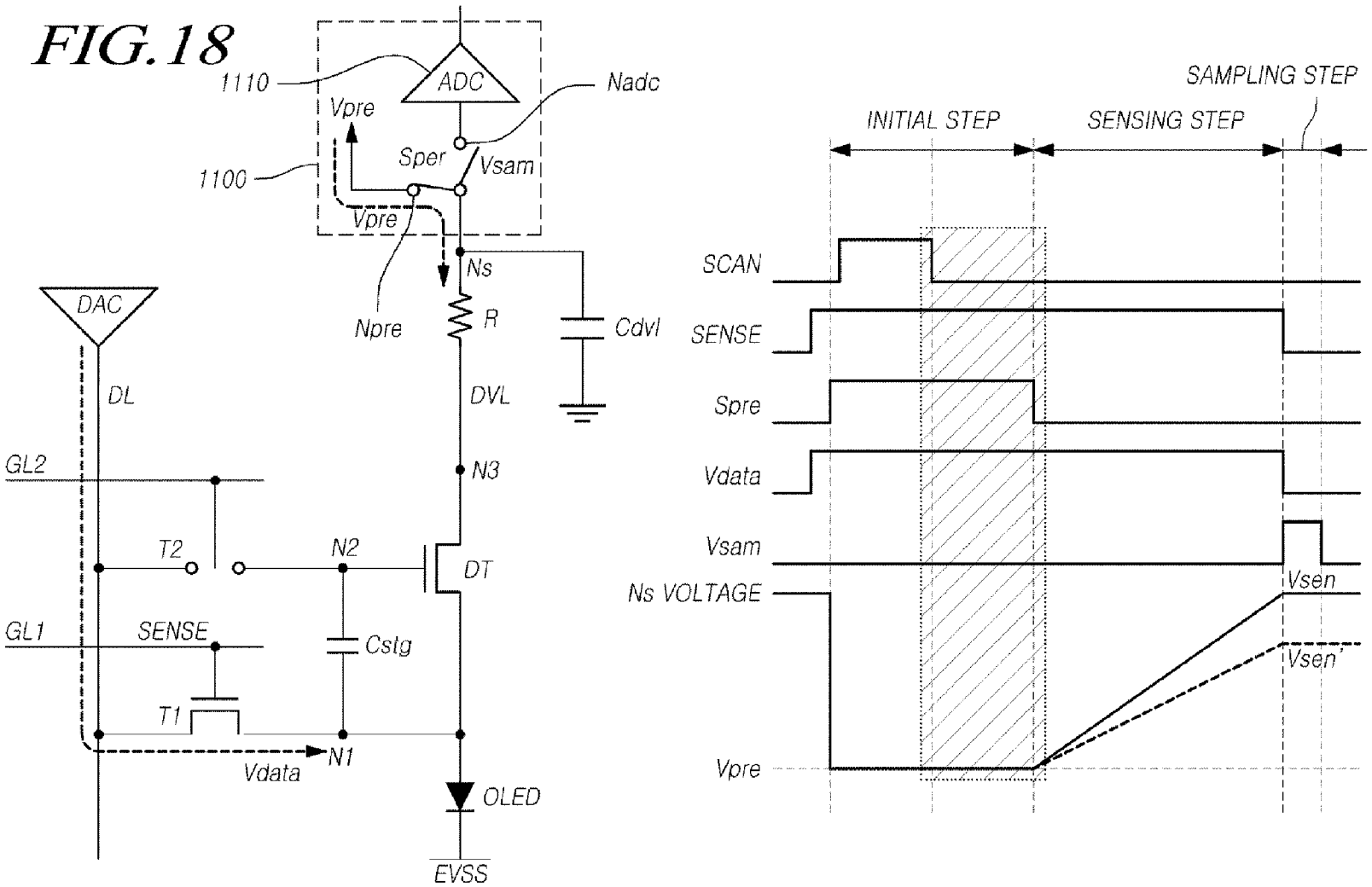

Referring to FIG. 18, in the second initial step of the mobility sensing mode based on voltage sensing, the scanning signal SCAN drops to a low level and the second transistor T2 is turned off.

As illustrated in FIG. 17 and FIG. 18, in the initial step (the first initial step and the second initial step) of the mobility sensing mode based on voltage sensing, the voltage of the sensing node Ns is maintained as the precharge voltage Vpre, because the first switch Sper has been turned on.

Figure 19:
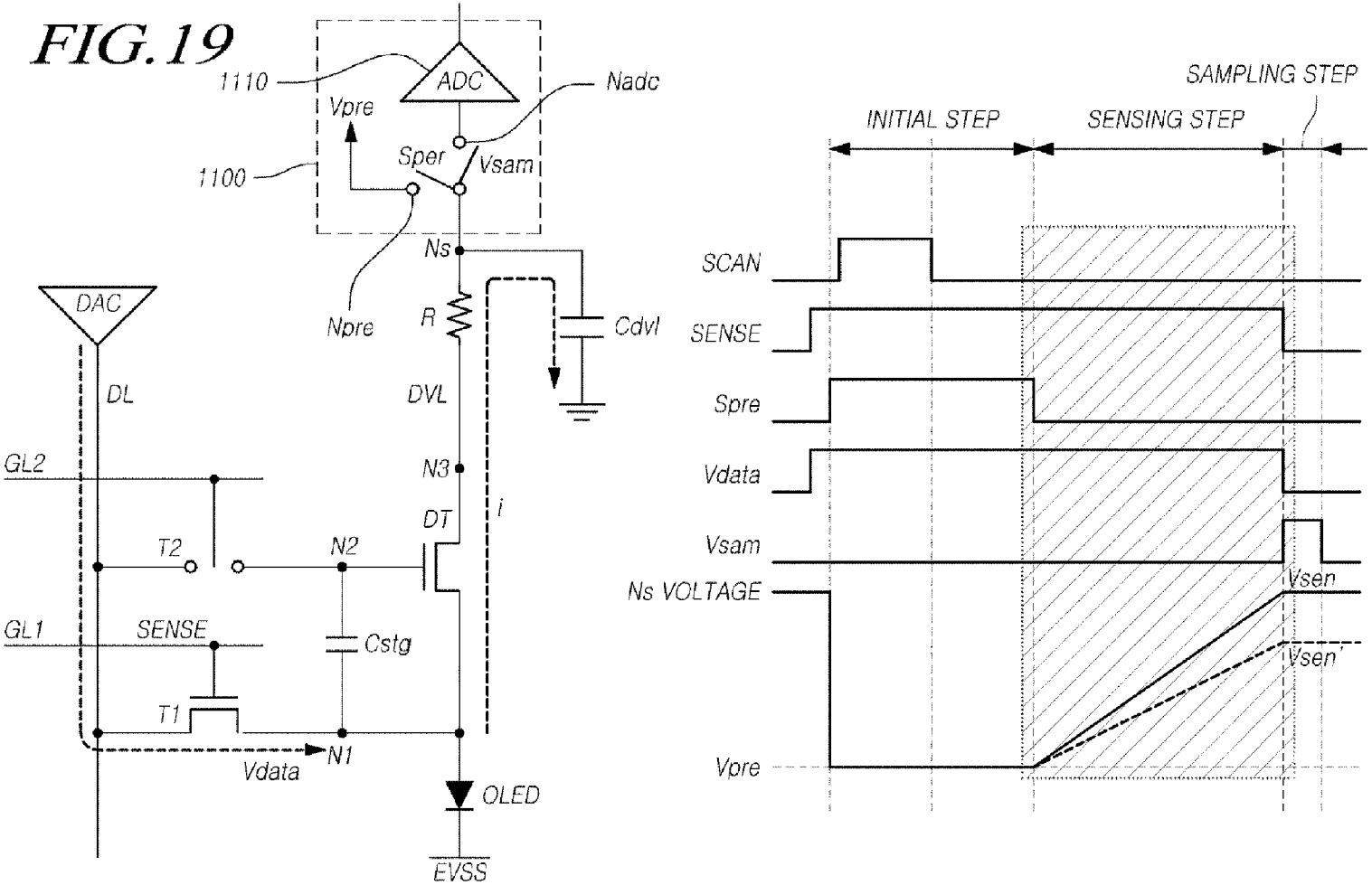

Referring to FIG. 19, in the sensing step of the mobility sensing mode based on voltage sensing, the first switch Sper is turned off, a constant current I flows from the first node N1 of the driving transistor DT to the driving voltage line DVL, and the driving voltage line capacitor Cdvl formed in the driving voltage line DVL is charged, so that the voltage of the sensing node Ns rises.

In the timing diagram of FIG. 19, a voltage slope of the sensing node Ns corresponds to the constant current I flowing from the first node N1 of the driving transistor DT to the driving voltage line DVL as a change in the voltage of the sensing node Ns according to the passage of time.

In the timing diagram of FIG. 19, a solid line representing a change in the voltage of the sensing node Ns indicates a voltage change in a case of high mobility, and a dotted line representing a change in the voltage of the sensing node Ns indicates a voltage change in a case of low mobility.

Figure 20:
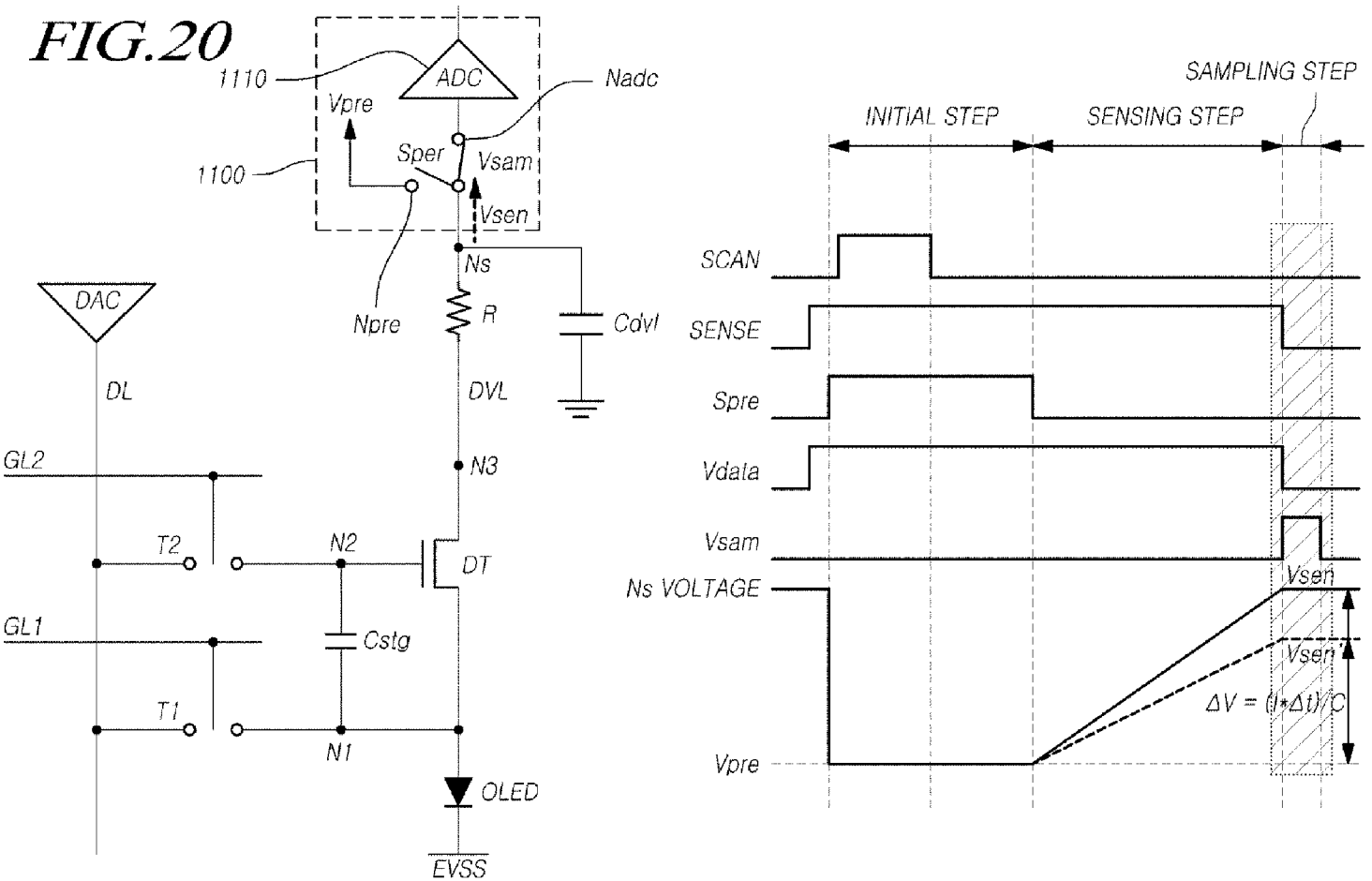

Referring to FIG. 20, in the sampling step of the mobility sensing mode based on voltage sensing, the sensing signal SENSE drops to a low level and the first transistor T1 is turned off, so that the voltage of the sensing node Ns does not rise.

At this time, since the second switch Vsam is turned on, the analog-to-digital converter 1110 measures the voltage of the sensing node Ns as the sensing voltage (Vsen or Vsen') and senses the mobility of the driving transistor DT from the measured voltage. In this case, the higher the sensing voltage (Vsen>Vsen') is, the higher the sensed mobility of the driving transistor DT is.

Thus far, the sensing mode (the threshold voltage sensing mode and the mobility sensing mode) of sensing the threshold voltage and the mobility based on voltage sensing has been described, and a sensing mode of sensing the threshold voltage and the mobility based on current sensing will be described with reference to FIG. 21 to FIG. 25 below.

Figure 21:
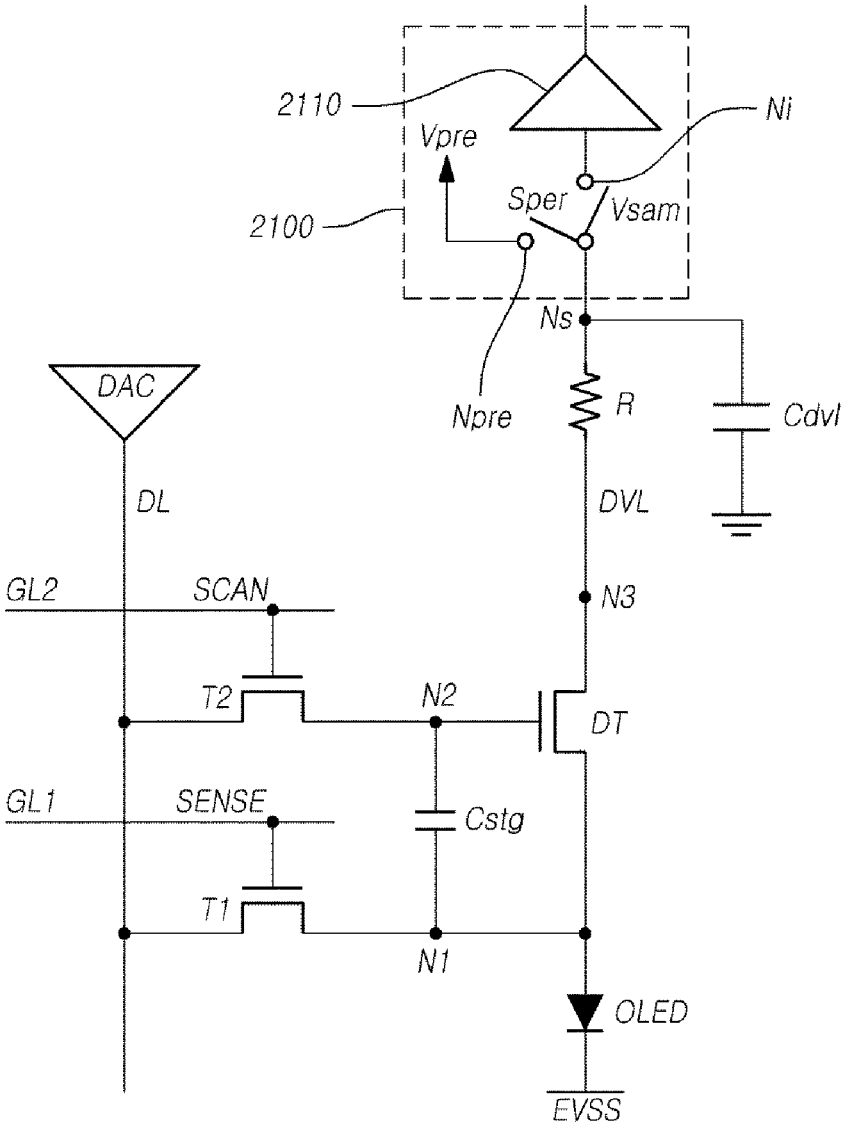
FIG. 21 is a circuit diagram illustrating a case in which a pixel of an organic light-emitting display device according to another exemplary embodiment operates in a sensing mode based on current sensing.

FIG. 21 is a circuit diagram illustrating a case in which a pixel of an organic light-emitting display device 500 according to another exemplary embodiment operates in a sensing mode based on current sensing.

Referring to FIG. 21, in the organic light-emitting display device 500 according to another exemplary embodiment, a current for the sensing mode based on current sensing further includes a sensing unit 2100 connected to the driving voltage line DVL on the basis of the pixel structure of FIG. 6.

Referring to FIG. 21, the sensing unit 2100 for the sensing mode based on current sensing includes a current measuring unit 2110 that measures a current flowing through the driving voltage line DVL, a first switch Sper that switches a connection between the precharge voltage supply node Npre and the sensing node Ns, and a second switch Vsam that switches a connection between a connection node N1 of the current measuring unit 2110 and the sensing node Ns.

When the first switch Sper is turned on, the precharge voltage supply node Npre and the sensing node Ns are connected to each other, and when the first switch Sper is turned off, the precharge voltage supply node Npre and the sensing node Ns are not connected to each other. When the second switch Vsam is turned on, the connection node N1 of the current measuring unit 2110 and the sensing node Ns are connected to each other, and when the second switch Vsam is turned off, the connection node N1 of the current measuring unit 2110 and the sensing node Ns are not connected to each other.

Furthermore, referring to FIG. 21, a resistor R may be connected between the driving voltage line DVL and the sensing node Ns, and a driving voltage line capacitor Cdvl may be formed in the driving voltage line DVL.

Figure 22:
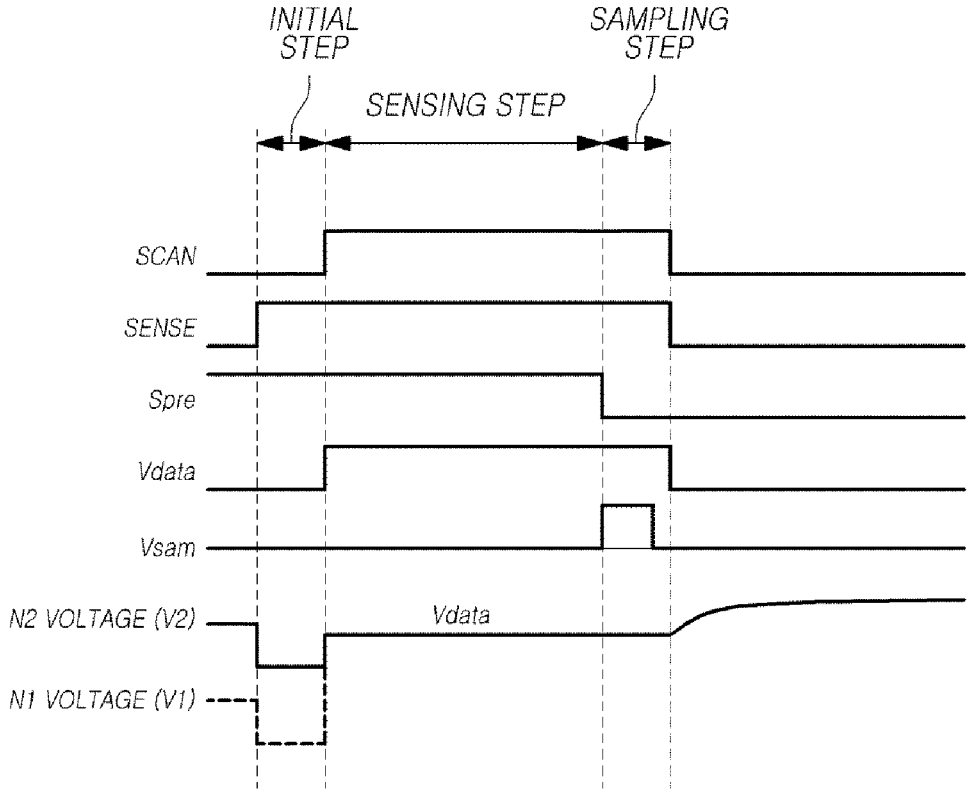
FIG. 22 is a timing diagram illustrating a case in which a pixel of an organic light-emitting display device according to another exemplary embodiment operates in a sensing mode based on current sensing.

FIG. 22 is a timing diagram illustrating a case in which a pixel of an organic light-emitting display device 500 according to another exemplary embodiment operates in a sensing mode based on current sensing.

Referring to FIG. 22, the sensing mode based on current sensing, in which the pixel of the organic light-emitting display device 500 according to another exemplary embodiment operates, includes an initial step, a sensing step and a sampling step.

In the sensing mode based on current sensing, when the data voltage Vdata is simultaneously applied to the second node N2 and the first node N1 of the driving transistor DT through the data line DL and the precharge voltage Vpre is applied to the driving voltage line DVL, a current flows from the first node N1 of the driving transistor DT to the driving voltage line DVL. This current is measured by the current measuring unit 2110.

In this case, currents I1 and I2 are measured for two data voltages Vdata1 and Vdata2, such that it is possible to calculate the threshold voltage and the mobility of the driving transistor DT based on a predetermined relationship.

Hereinafter, each step of the sensing mode based on current sensing will be described with reference to FIG. 23 to FIG. 25.

Figure 23:
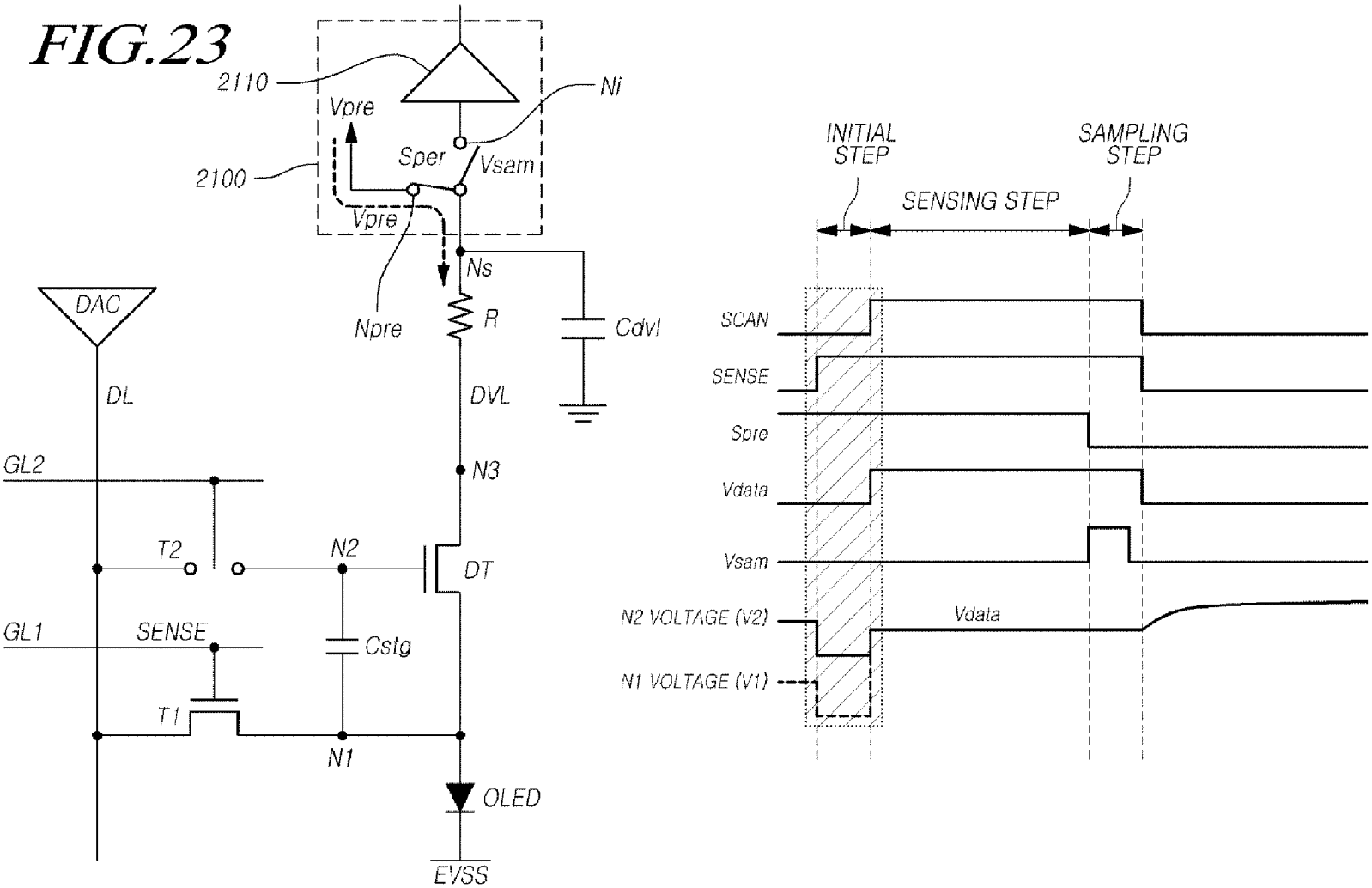
FIG. 23 to FIG. 25 are circuit diagrams when a pixel of an organic light-emitting display device according to another exemplary embodiment operates in a sensing mode based on current sensing.
Figure 24:
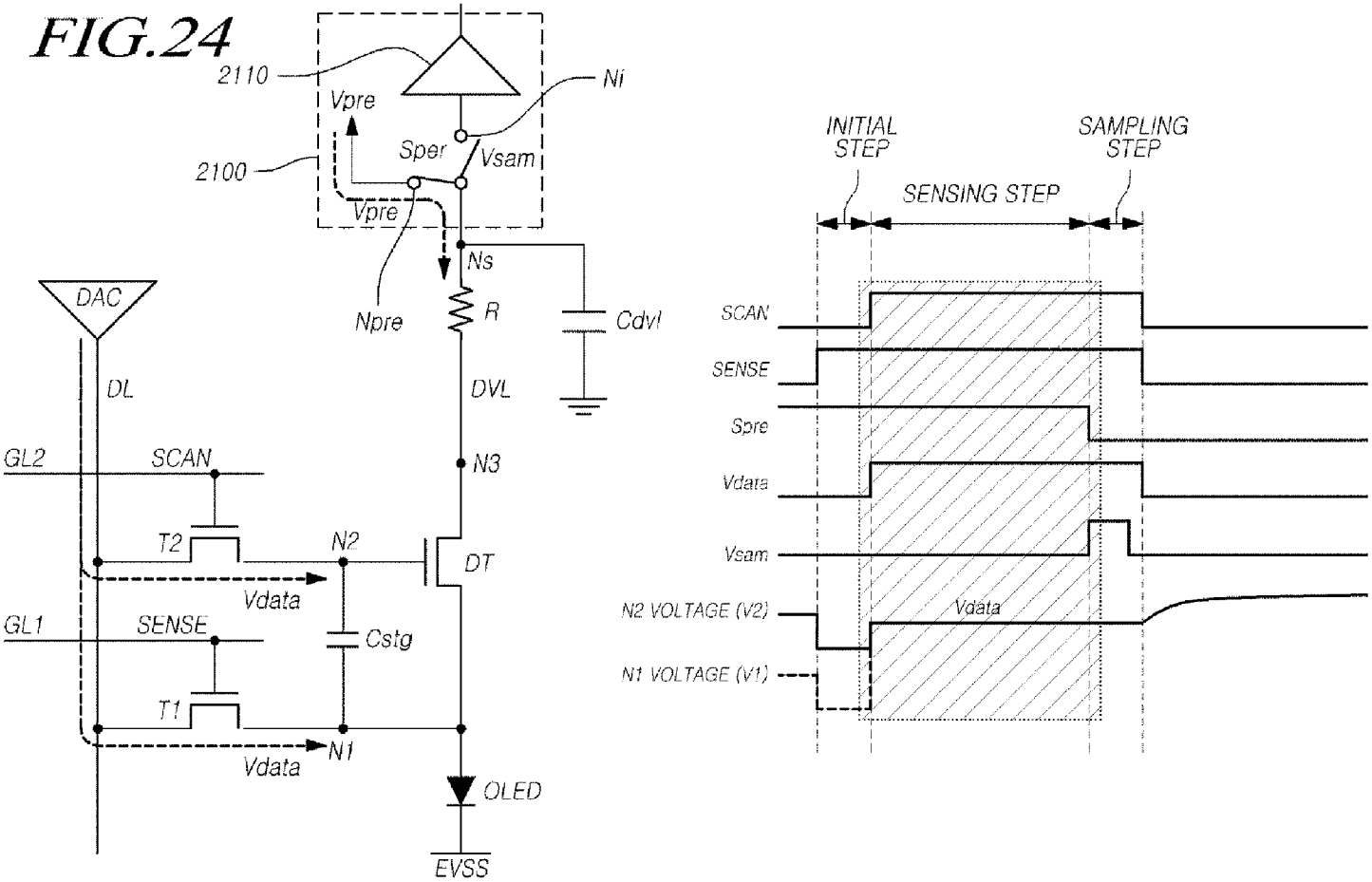
Figure 25:
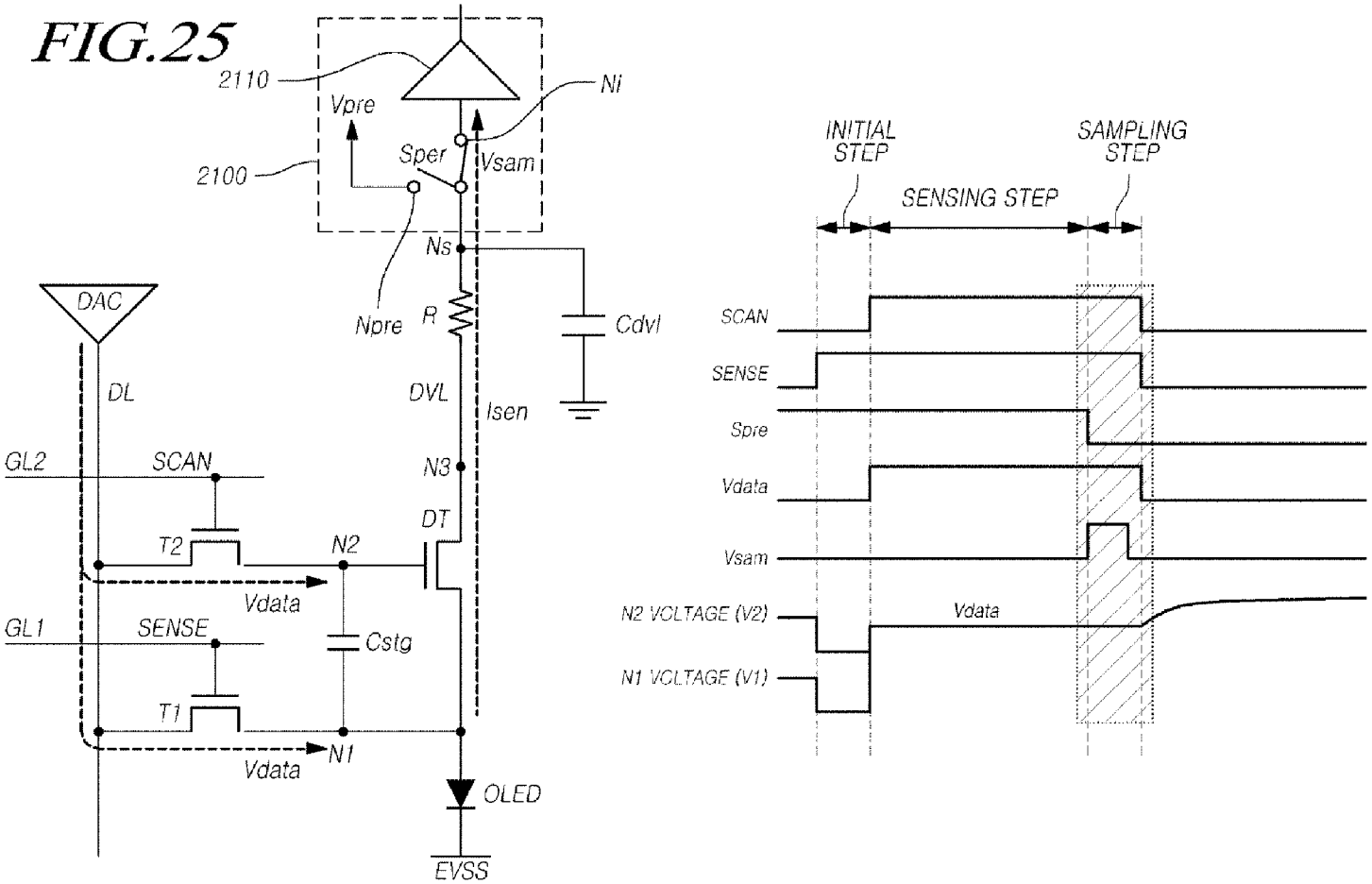

FIG. 23 to FIG. 25 are circuit diagrams when a pixel of an organic light-emitting display device 500 according to another exemplary embodiment operates in a sensing mode based on current sensing.

Referring to FIG. 23, in the initial step of the sensing mode based on current sensing, the second transistor T2 has been turned off by a low level of the scanning signal SCAN, the first transistor T1 is turned on by the sensing signal SENSE, and the first switch Sper is turned on, so that the precharge voltage Vpre is applied to the sensing node Ns.

Referring to FIG. 24, in the sensing step of the sensing mode based on current sensing, the scanning signal SCAN is changed to a high level and the second transistor T2 is turned on, so that the data voltage Vdata is supplied through the data line DL.

Accordingly, the data voltage Vdata is applied to the second node N2 and the first node N1 of the driving transistor DT. That is, voltages of the second node N2 and the first node N1 of the driving transistor DT are the data voltage Vdata.

Referring to FIG. 25, in the sampling step of the sensing mode based on current sensing, the first switch Sper is turned off and the second switch Vsam is turned on.

Accordingly, a current flowing from the first node N1 of the driving transistor DT to the driving voltage line DVL is measured as a sensing current Isen.

The aforementioned process is performed for the two data voltages Vdata1 and Vdata2, thereby measuring two sensing currents $I_1$ and $I_2$.

Afterwards, based on the applied two data voltages Vdata1 and Vdata2, the measured two sensing currents $I_1$ and $I_2$ and the applied precharge voltage Vpre, two formulae of the following Formula 1 are used to calculate two unknowns Vth and K, such that it is possible to sense a threshold voltage Vth and a mobility K.

$$(1)\ I_1=K(V_{gs1}-V\text{th})^2$$

$$(2)\ I_2=K(V_{gs2}-V\text{th})^2 \qquad \text{Formula 1:}$$

In Formula 1, $I_1$ and $I_2$ indicate currents measured by the current measuring unit 2110. $V_{gs1}$ indicates a voltage difference between the second node N2 and the third node N3 of the driving transistor DT when the data voltage Vdata1 is applied, and may be regarded as "Vdata1−Vpre." $V_{gs2}$ indicates a voltage difference between the second node N2 and the third node N3 of the driving transistor DT when the data voltage Vdata2 is applied, and may be regarded as "Vdata2−Vpre." Accordingly, the following Formula 1 may be rewritten as the following Formula 2.

(1) $I_1=K(V\text{data1}-V\text{pre}-V\text{th})^2$ (2) $I_2=K(V\text{data2}-V\text{pre}-V\text{th})^2$ Formula 2:

In Formula 2, since $I_1$, $I_2$, Vdata1, Vdata2 and Vpre are well-known values, it is possible to obtain the threshold voltage Vth and the mobility K that are unknown based on Formulae (1) and (2).

Thus far, respective pixel structures of the organic light-emitting display device 500 according to another exemplary embodiment and the driving methods for the emission mode and the sensing mode have been described.

Hereinafter, with reference to FIG. 26, a pixel structure of an organic light-emitting display device 500 according to another exemplary embodiment will be described, along with advantages thereof.

Figure 26:
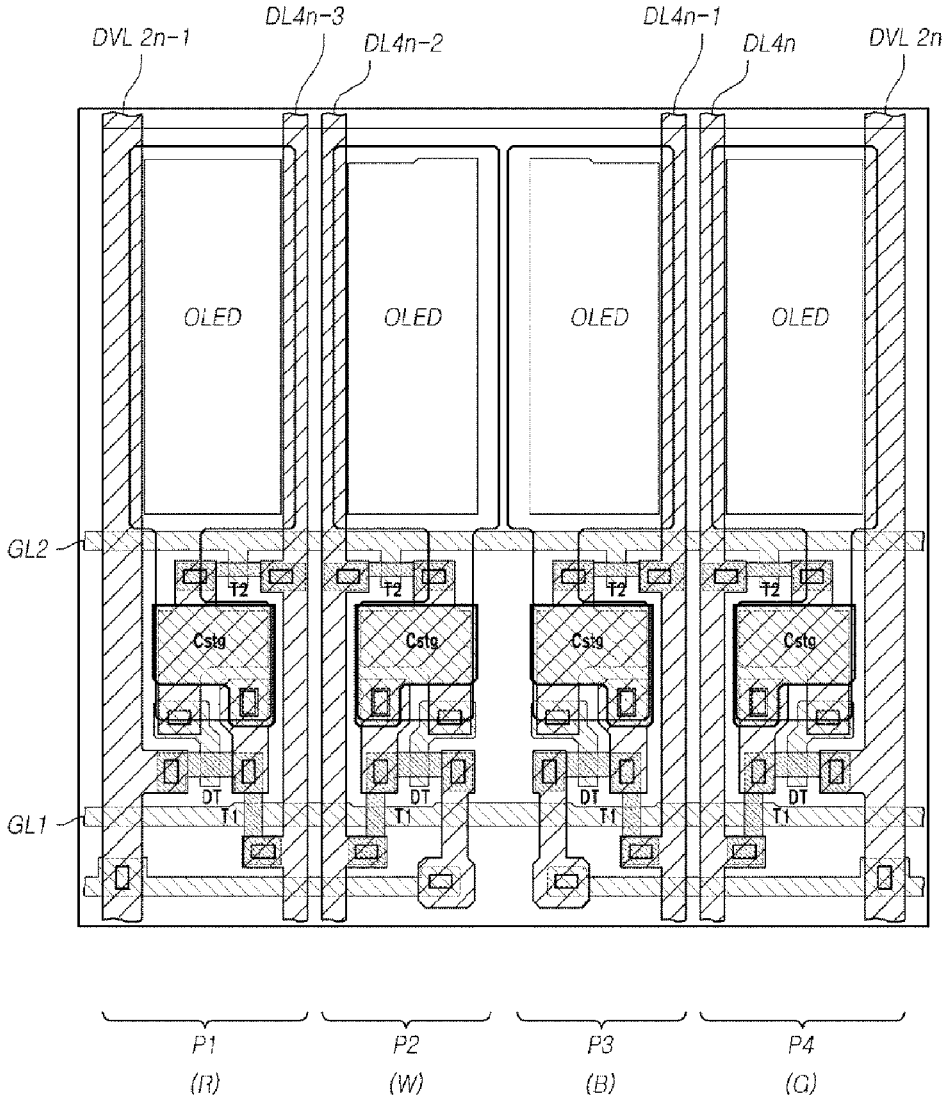
FIG. 26 is a top plan view illustrating a display panel of an organic light-emitting display device according to another exemplary embodiment.

FIG. 26 is a top plan view illustrating a display panel 510 of an organic light-emitting display device 500 according to another exemplary embodiment, a part of which includes four pixels P1 to P4.

Referring to FIG. 26, the pixel P1 is connected to a $4n-3^{th}$ data line DL4n−3, the pixel P2 is connected to a $4n-2^{th}$ data line DL4n−2, the pixel P3 is connected to a $4n-1^{th}$ data line DL4n−1, and the pixel P4 is connected to a $4n^{th}$ data line DL4n.

As illustrated in FIG. 26, no reference voltage line RVL is formed for the four pixels P1 to P4, and the data line DL is connected to the first transistor T1 and the second transistor T2. Also, two driving voltage lines DVL2n−1 and DVL2n are formed at both sides of the four pixels P1 to P4. The two data lines DL4n−3 and DL4n−2 for supplying the data voltages to the two pixels P1 and P2 are formed between the pixel P1 and the pixel P2, and the two data lines DL4n−1 and DL4n for supplying the data voltages to the two pixels P3 and P4 are formed between the pixel P3 and the pixel P4.

In the pixels P1 and P2, the arrangement structure of the two data lines DL4n−3 and DL4n−2 is symmetrical to the arrangement structure of three transistors DT, T1 and T2 and one capacitor Cstg in each pixel. Similarly, in the pixels P3 and P4, the arrangement structure of the two data lines DL4n−1 and DL4n is symmetrical to the arrangement structure of three transistors DT, T1 and T2 and one capacitor Cstg in each pixel.

Furthermore, the two driving voltage lines DVL2n−1 and DVL2n are symmetrically arranged at both sides of the pixel P1 and the pixel P4.

Such a symmetrical structure is repeatedly formed for every four pixels, so that the display panel 510 can be easily manufactured.

The structure of the display panel 510 illustrated in FIG. 26 may be a structure suitable for a display panel 510 in which pixels are patterned to represent WRGB. That is, the pixels P1 to P4 may be WRGB pixels.

Figure 27:
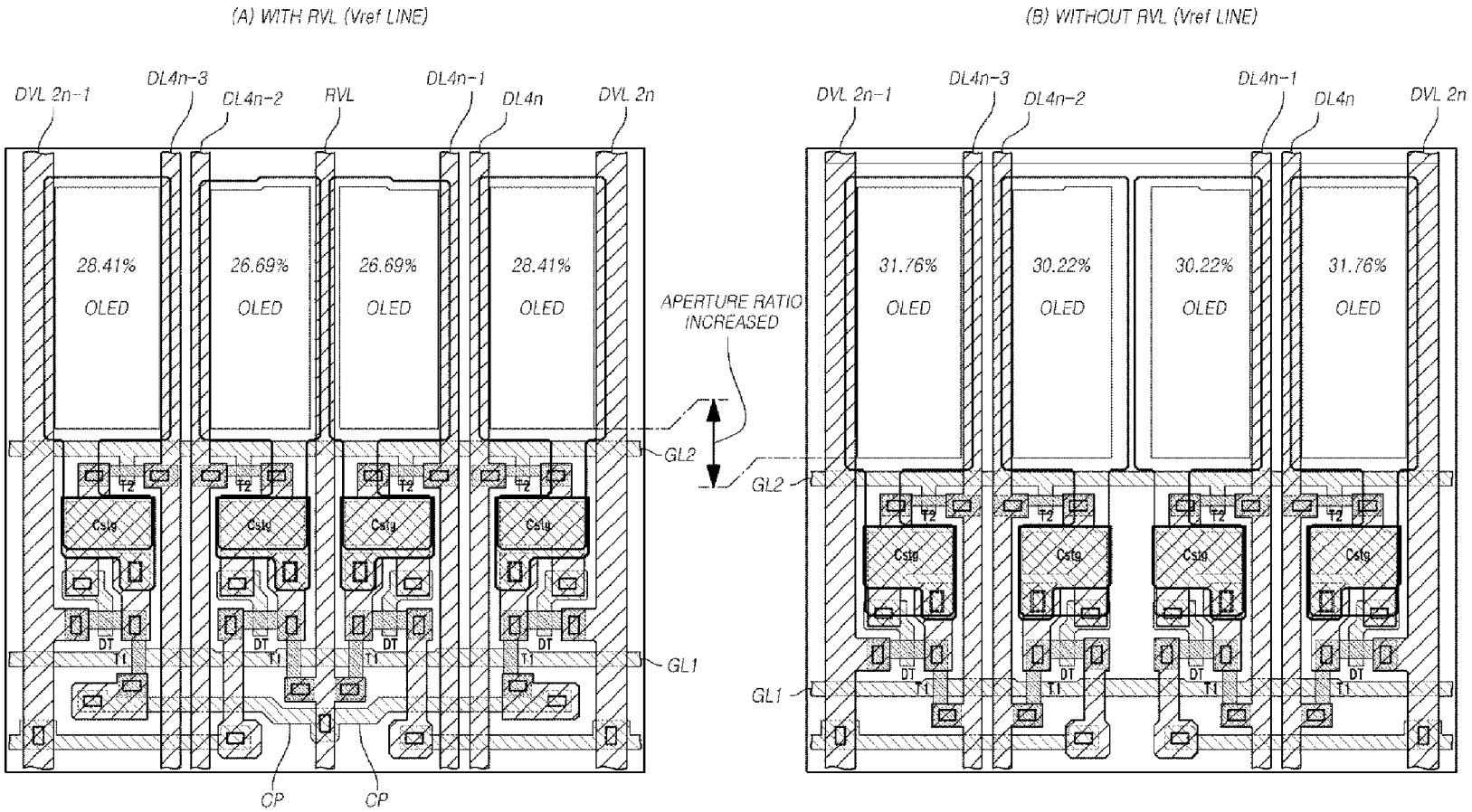
FIG. 27 is a diagram obtained by comparing a display panel according to an exemplary embodiment with a display panel according to another exemplary embodiment.

FIG. 27 is a diagram for comparing the display panel 510 of the organic light-emitting display device 500 illustrated in FIG. 26 with the display panel 110 of the organic light-emitting display device 100 illustrated in FIG. 4. In particular, the figure labeled as (A) illustrates the display panel 110 of FIG. 4, and the figure labeled as (B) illustrates the display panel 510 of FIG. 26.

In the display panel 510 illustrated in (B) of FIG. 27, since there is no reference voltage line RVL between the pixel P2 connected to the DL4n−2 and the pixel P3 connected to the DL4n−1, an emission area of each pixel can be increased in a horizontal direction.

Furthermore, in the display panel 510 illustrated in (B) of FIG. 27, since there is no connection pattern (CP) for connecting the reference voltage line RVL to the first transistor T1 of the pixel P1 and the first transistor T4 of the pixel P4 as in (A) of FIG. 27, the emission area of each pixel can also be increased in a vertical direction.

As a result, the organic light-emitting display device 500 illustrated in (B) of FIG. 27 has an advantage in that an aperture ratio is increased by more than about 3%, as compared with the organic light-emitting display device 100 illustrated in (A) of FIG. 27.

Furthermore, in the organic light-emitting display device 500 illustrated in (B) of FIG. 27, since the reference voltage supply unit 160 and the reference voltage line are not separately provided, it may not be necessary to provide contact pins through which the data driving integrated circuit D-IC receives a reference voltage from the reference voltage supply unit 160 and transfers the reference voltage to the reference voltage line. As a result, it may be possible to reduce the number of contact pins of the data driving integrated circuit D-IC, reduce the area of the data driving integrated circuit, and reduce the cost.

As described above, organic light-emitting display devices 100 and 500 according to embodiments of the present invention have a novel pixel structure and/or operating method thereof, with a high aperture ratio.

Furthermore, an organic light-emitting display device 500 according to an embodiment of the present invention has a pixel structure in which a reference voltage line is be required, and an overlapping area with additional signal lines (for example, connection patterns (CP)) is reduced, leading to a further increased aperture ratio.

In addition, an organic light-emitting display device 500 according to an embodiment of the present invention has a pixel structure that can reduce the number of contact pins and the area of a data driving integrated circuit (D-IC), leading to reduced manufacturing costs.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An organic light-emitting display device comprising:

a display panel including a plurality of data lines, a plurality of first gate lines and a plurality of second gate lines, which define a plurality of pixels;

a data driver supplying a data signal through at least one of the plurality of data lines;

a first gate driver supplying a sensing signal through at least one of the plurality of first gate lines that cross the plurality of data lines in the display panel;

a second gate driver supplying a scanning signal through at least one of the plurality of second gate lines that are substantially parallel with the plurality of first gate lines in the display panel; and a timing controller controlling driving timings of the data driver, the first gate driver and the second gate driver, wherein one of the plurality of pixels includes an organic light-emitting diode, a driving transistor having a first node, a second node and a third node, a first transistor controlled by the sensing signal and connected between the respective data line and the first node of the driving transistor, a second transistor controlled by the scanning signal and connected between the respective data line and the second node of the driving transistor, and a storage capacitor connected between the first and second nodes of the driving transistor; and a sensing unit sensing a threshold voltage or a mobility of the driving transistor, wherein the sensing unit is connected to a driving voltage line connected to the third node of the driving transistor, the sensing unit comprises:

an analog-to-digital converter measuring a voltage of a sensing node connected to the driving voltage line, and a switch switching a connection between a precharge voltage supply node and the sensing node and switching a connection between a connection node of the analog-to-digital converter and the sensing node.

2. The organic light-emitting display device according to claim 1, wherein the data driver is configured for supplying the respective data line a reference voltage or a data voltage according to an operating timing of a corresponding pixel.

3. The organic light-emitting display device according to claim 1, wherein, the first gate driver is configured to supply a sensing signal which turns on or off the first transistor, the data driver is configured to supply a reference voltage or a data voltage to the respective data line, and the second gate driver is configured to supply a scanning signal which turns on or off the second transistor, wherein, in an emission mode of the organic light-emitting display device, the first gate driver, the second gate driver and the data driver are configured to operate the one of the plurality of pixels such that:

in an initial step of the emission mode, the first transistor is turned on by the first gate driver and the reference voltage is applied to the first node of the driving transistor by the data driver, in a writing step following the initial step, the first transistor is turned off by the first gate driver and the second transistor is turned on by the second gate driver and a data voltage is applied to the second node of the driving transistor by the data driver, and in an emission step following the writing step, the second transistor is turned off by the second gate driver so that a current flows through the organic light-emitting diode.

4. The organic light-emitting display device according to claim 1, wherein the sensing unit comprises:

a current measuring unit measuring a current flowing through a sensing node connected to the driving voltage line; and a switch switching a connection between a precharge voltage supply node and the sensing node and switching a connection between a connection node of the current measuring unit and the sensing node.

5. A driving method of an organic light-emitting display device, the method comprising driving the organic light-emitting display device in an emission mode and a sensing mode, wherein:

in the emission mode, the driving method comprising:

turning on a first transistor connected between a data line and a first node of the driving transistor and applying a reference voltage through the data line to the first node of the driving transistor;

subsequently turning off the first transistor to float a voltage of the first node of the driving transistor, and applying a data voltage through the data line to a second node of the driving transistor through a second transistor connected between the data line and the second node of the driving transistor;

subsequently turning off the second transistor to allow a current to flow through an organic light-emitting diode connected to a third node of the driving transistor; and in the sensing mode, the driving method comprising:

turning on a precharge switch coupled to a sensing node which is connected to the third node of the driving transistor to apply a precharge voltage to the sensing node, and turning on the second transistor and applying a data voltage to the second node of the driving transistor;

subsequently turning off the precharge switch, and turning on the first transistor and applying the data voltage to the first node, so that a voltage of the sensing node increase;

subsequently turning off the first transistor when the voltage increase of the sensing node stops and turning on a sampling switch coupled to the sensing node to sense the voltage of the sensing node; and subsequently determining the threshold voltage of the driving transistor from the sensed voltage of the sensing node.

6. A driving method of an organic light-emitting display device, the method comprising driving the organic light-emitting display device in an emission mode and a sensing mode, wherein:

in the emission mode, the driving method comprising:

turning on a first transistor connected between a data line and a first node of the driving transistor and applying a reference voltage through the data line to the first node of the driving transistor;

subsequently turning off the first transistor to float a voltage of the first node of the driving transistor, and applying a data voltage through the data line to a second node of the driving transistor through a second transistor connected between the data line and the second node of the driving transistor;

subsequently turning off the second transistor to allow a current to flow through an organic light-emitting diode connected to a third node of the driving transistor; and in the sensing mode, the driving method comprising:

turning on a precharge switch coupled to a sensing node which is connected to the third node of the driving transistor to apply a precharge voltage to the sensing node, and turning on the first and second transistors to apply a data voltage to the first and second nodes of the driving transistor;

subsequently turning off the second transistor;

subsequently turning off the precharge switch, so that a voltage of the sensing node increase;

subsequently turning off the first transistor, so that the voltage increase of the sensing node stops, and turning on a sampling switch coupled to the sensing node to sense the voltage of the sensing node; and subsequently determining the mobility of the driving transistor from the sensed voltage of the sensing node.

7. The organic light-emitting display device according to claim 1, further comprising a resistor connected between the driving voltage line and the sensing node.

8. The organic light-emitting display device according to claim 1, further comprising a driving voltage line capacitor formed in the driving voltage line and the voltage of the sensing node is a voltage charged in the driving voltage line capacitor.

* * * * *